US008057007B2

(12) United States Patent
Sasayama

(10) Patent No.: US 8,057,007 B2
(45) Date of Patent: Nov. 15, 2011

(54) IMAGE RECORDING APPARATUS AND METHOD, AND METHOD OF DETERMINING DENSITY CORRECTION COEFFICIENTS

(75) Inventor: Hiroyuki Sasayama, Kanagawa-ken (JP)

(73) Assignee: FujiFilm Corporation, Tokyo (JP)

( * ) Notice: Subject to any disclaimer, the term of this patent is extended or adjusted under 35 U.S.C. 154(b) by 480 days.

(21) Appl. No.: 12/236,599

(22) Filed: Sep. 24, 2008

(65) Prior Publication Data

US 2009/0079782 A1 Mar. 26, 2009

(30) Foreign Application Priority Data

Sep. 25, 2007 (JP) ..... 2007-247972

(51) Int. Cl.
*B41J 2/01* (2006.01)

(52) U.S. Cl. ..... 347/19; 347/14; 347/15

(58) Field of Classification Search ..... 347/14, 347/15, 19

See application file for complete search history.

(56) References Cited

U.S. PATENT DOCUMENTS

2005/0083360 A1* 4/2005 Nakanishi et al. ..... 347/12
2006/0262151 A1* 11/2006 Chiwata ..... 347/14

FOREIGN PATENT DOCUMENTS

JP 2006-212907 A 8/2006
JP 2006-347164 A 12/2006

* cited by examiner

*Primary Examiner* — Laura Martin

(74) *Attorney, Agent, or Firm* — Birch, Stewart, Kolasch & Birch, LLP

(57) ABSTRACT

An image recording apparatus includes: a recording head which has a plurality of recording elements; a characteristics information acquisition device which acquires information that indicates recording characteristics of the plurality of recording elements; a correction object determination device which selects from the plurality of recording elements a correction object recording element to be corrected; a correction range setting device which selects from the plurality of recording elements N correction recording elements to be used for correcting an output density, N being an integer not less than 2; a virtual dot setting device which sets a virtual dot to be arranged between dots recorded by the selected correction recording elements; a correction coefficient determination device which determines density correction coefficients for the N correction recording elements in accordance with correction conditions that reduce a low-frequency component of a power spectrum representing spatial frequency characteristics of the density non-uniformity; a correction processing device which performs calculation for correcting the output density by using the density correction coefficients; and a drive control device which controls the plurality of recording elements in accordance with the corrected output density.

16 Claims, 16 Drawing Sheets

IMAGE RECORDING APPARATUS AND METHOD, AND METHOD OF DETERMINING DENSITY CORRECTION COEFFICIENTS

BACKGROUND OF THE INVENTION

1. Field of the Invention

The present invention relates to an image recording apparatus and method, a method of determining density correction coefficient and a computer-readable medium therefor, and more particularly to image processing technology which is suitable for correcting density variations caused by variation in characteristics among a plurality of recording elements in a recording head.

2. Description of the Related Art

An image recording apparatus (inkjet printer) has been used which includes an inkjet type of recording head having a plurality of ink ejection ports (nozzles). In this type of image recording apparatus, problems of image quality are liable to arise due to the occurrence of density variations (density non-uniformities) in the recorded image caused by variations in the ejection characteristics of the nozzles. FIG. 19 is an illustrative diagram showing a schematic view of examples of variations in the ejection characteristics of the nozzles, and density variations appearing in recording results.

In FIG. 19, reference numeral 300 represents a line head, reference numeral 302-*i* (where i=1 to 8) represents a nozzle, reference numeral 304-*i* (i=1 to 8) represents a dot formed by a droplet ejected from the nozzle 302-*i* (i=1 to 8). Here, it is supposed that the recording medium, such as recording paper, is conveyed in a direction perpendicular to the breadthways direction of the line head 300 (the nozzle arrangement direction) (namely, in the direction of arrow S), and the nozzle arrangement direction in the line head 300 is taken to be the main scanning direction, while the direction of relative conveyance of the recording medium with respect to the line head 300 (the direction S) is taken to be the sub-scanning direction.

In the example shown in FIG. 19, a depositing position error occurs at the nozzle 302-3, which is third from the left (namely, the droplet ejected from the nozzle 302-3 deposits on the recording medium at a position diverging from the originally intended depositing position in the leftward direction in FIG. 19), and a droplet volume error occurs at the sixth nozzle 302-6 (namely, the droplet ejected from the nozzle 302-6 has a greater droplet volume than the originally intended volume). In this case, density non-uniformity streaks occur at the positions in the print image corresponding to the nozzles 302-3 and 302-6 producing the depositing position error and the droplet volume error (namely, the positions indicated by A and B in FIG. 19).

In the case of a serial (shuttle) scanning type of image recording apparatus, which performs image recording by driving a recording head to scan a plurality of times over the prescribed print region, it is possible to avoid density non-uniformities by means of a commonly known multi-pass printing method, but in the case of a single pass system (line head system) which records images by means of a single scanning action, it is difficult to avoid density non-uniformities.

Since it is difficult to completely prevent variations in ejection characteristics among the nozzles in terms of the process of manufacturing the recording head, then various technologies for correcting the variations have been proposed (see, Japanese Patent Application Publication Nos. 2006-212907 and 2006-347164).

With the object of eliminating stripe-shaped non-uniformities (banding) caused by a so-called "flight deflection effect", Japanese Patent Application Publication No. 2006-212907 proposes identifying pixels where flight deflection has occurred, setting the adjacent pixels (pixels for correction) which are within a previously established distance range of the pixel suffering flight deflection, and then correcting the pixel values of these pixels for correction in accordance with the amount of flight deflection. According to Japanese Patent Application Publication No. 2006-212907, a table of correction values corresponding to flight deflection is created by establishing respective hypothetical regions between a pixel suffering flight deflection and the pixels for correction which are adjacent on either side of this pixel, calculating the pixel density in each of these regions, and then establishing correction values on the basis of the calculated pixel densities in such a manner that the density is uniform in each of the regions (see paragraphs [0129] to [0132] in Japanese Patent Application Publication No. 2006-212907).

Japanese Patent Application Publication No. 2006-347164 discloses outputting a test pattern, obtaining depositing position error data from the print results, using this depositing position error data to define a density profile D(x) which incorporates the error characteristics of respective nozzles, converting this density profile into a function T(f) by Fourier transform and then calculating a density correction coefficient by minimizing the low-frequency component of the power spectrum of this function (paragraphs [0062] to [0089] in Japanese Patent Application Publication No. 2006-347164).

However, in the technology described in Japanese Patent Application Publication No. 2006-212907, it is difficult to calculate appropriate correction values if a large number of pixels suffering flight deflection occur continuously, and problems arise in that either correction is not performed correctly, or the load involved in calculating the correction values becomes extremely great. Furthermore, if the adjacent dots are mutually overlapping, then the overlapping portion does not produce a linear density with respect to the ink volume (ink thickness) (namely, it shows non-linear characteristics), but Japanese Patent Application Publication No. 2006-212907 does not take account of the non-linear characteristics of the density in a case where the droplets deposited onto mutually adjacent pixels overlap with each other. This point applies similarly to Japanese Patent Application Publication No. 2006-347164.

SUMMARY OF THE INVENTION

The present invention has been contrived in view of the foregoing, an object thereof being to provide an image recording apparatus and image recording method, whereby density correction (non-uniformity correction) of higher accuracy can be achieved by taking account of the non-linear characteristics of the density caused by overlapping between dots of mutually adjacent pixels, and to provide an image recording method, as well as a method for determining density correction coefficients which is valuable in this correction processing and a computer-readable medium storing instructions causing a computer to perform the steps of the method for determining density correction coefficients.

In order to attain the aforementioned object, the present invention is directed to an image recording apparatus which records an image on a recording medium, the image recording apparatus comprising: a recording head which has a plurality of recording elements; a conveyance device which conveys at least one of the recording head and the recording medium so that the recording head and the recording medium move relatively to each other; a characteristics information acquisition device which acquires information that indicates recording characteristics of the plurality of recording elements; a correction object determination device which selects from the plurality of recording elements a correction object recording element to be corrected, the correction object recording element having the recording characteristics that cause density non-uniformity in the image; a correction range setting device which selects from the plurality of recording elements N correction recording elements to be used for correcting an output density, N being an integer not less than 2; a virtual dot setting device which sets a virtual dot to be arranged between dots recorded by the selected correction recording elements, the virtual dot being set for calculation purposes and not actually recorded on the recording medium, the virtual dot setting device also determining a virtual density of the virtual dot for calculation purposes; a correction coefficient determination device which calculates the density non-uniformity caused by the virtual dot and the recording characteristics of the correction object recording element and which determines density correction coefficients for the N correction recording elements in accordance with correction conditions that reduce a low-frequency component of a power spectrum representing spatial frequency characteristics of the calculated density non-uniformity; a correction processing device which performs calculation for correcting the output density by using the density correction coefficients determined by the correction coefficient determination device; and a drive control device which controls the plurality of recording elements in accordance with the output density corrected by the correction processing device.

Non-uniformities in the density of a recorded image (density non-uniformities) can be represented by the intensity of the spatial frequency characteristics (power spectrum), and the visibility of a density non-uniformity can be evaluated by means of the low-frequency component of the power spectrum. In the present invention, the virtual dots having virtual densities are established for the purpose of calculation at positions between the dots (actual dots) which are actually recorded by the recording elements, when performing calculation in order to determine density correction coefficients using conditions which reduce the low-frequency component of the power spectrum after correction using the density correction coefficients. The density non-uniformities including virtual dots and actual dots are calculated.

By this means, it is possible to calculate the non-linearity of the density in the overlapping portions of the actual dots by substituting the virtual densities of the virtual dots, and therefore more accurate correction of non-uniformities (suitable density correction) can be achieved.

The "characteristics information acquisition device" may acquire information by storing information relating to recording failure positions, previously, in a storage device such as a memory, and then reading out the required information, or it may acquire information 5 relating to recording characteristics by printing an actual test pattern, or the like, and then reading in and analyzing the print results. Considering that the recording characteristics change over time, a desirable mode is one in which the information is updated at suitable times.

An inkjet recording apparatus which forms an image recording apparatus according to an embodiment of the present invention comprises: a liquid ejection head (corresponding to a "recording head") having a droplet ejection element row in which a plurality of droplet ejection elements (corresponding to "recording elements") are arranged in a row, each droplet ejection element including a nozzle for ejecting an ink droplet in order to form a dot and a pressure generating device (piezoelectric element, heating element, or the like) which generates an ejection pressure; and an ejection control device which controls the ejection of droplets from the recording head on the basis of ink ejection data generated from the image data. An image is formed on a recording medium by means of the droplets ejected from the nozzles. In the present specification, a dot recorded by a liquid droplet ejected from a nozzle is called a "deposited droplet".

A compositional example of a recording head is a full line type head having a recording element row in which a plurality of recording elements (nozzles) are arranged through a length corresponding to the full width of the recording medium. In this case, a mode may be adopted in which a plurality of relatively short recording head modules having recording element rows which do not reach a length corresponding to the full width of the recording medium are combined and joined together, thereby forming recording element rows of a length that correspond to the full width of the recording medium.

A full line type head is usually arranged in a direction that is perpendicular to the relative feed direction (relative conveyance direction) of the recording medium, but a mode may also be adopted in which the recording head is arranged following an oblique direction that forms a prescribed angle with respect to the direction perpendicular to the conveyance direction.

The "recording medium" indicates a medium on which an image is recorded by means of the action of the recording head (this medium may also be called an image forming medium, print medium, image receiving medium, or, in the case of an inkjet recording apparatus, an ejection medium or ejection receiving medium, or the like). This term includes various types of media, irrespective of material and size, such as continuous paper, cut paper, sealed paper, resin sheets, such as OHP sheets, film, cloth, an intermediate transfer body, a printed circuit board on which a wiring pattern, or the like, is printed by means of an inkjet recording apparatus, and the like.

The "conveyance device" may include a mode where the recording medium is conveyed with respect to a stationary (fixed) recording head, or a mode where a recording head is moved with respect to a stationary recording medium, or a mode where both the recording head and the recording medium are moved.

When forming color images by means of an inkjet head, it is possible to arrange recording heads for inks of a plurality of colors (recording liquids), or it is possible to eject inks of a plurality of colors from a single recording head.

Furthermore, the present invention is not limited to a full line head, and may also be applied to a serial (shuttle) scanning type recording head (a recording head which ejects droplets while moving reciprocally in a direction substantially perpendicular to the conveyance direction of the recording medium).

Preferably, the correction conditions are such that differential coefficients of the power spectrum representing the spatial frequency characteristics of the density non-uniformity become substantially zero at a frequency origin point ($f=0$).

According to this aspect of the present invention, since the density correction coefficients are determined by using conditions under which the differential coefficients at the frequency origin point ($f=0$) of the power spectrum after correction using the density correction coefficients become substantially zero, then the intensity of the power spectrum becomes a minimum at the frequency origin point and the power spectrum can hence be reduced to a low value in the vicinity of the origin (in other words, in the low-frequency region). Accordingly, highly accurate correction of non-uniformity can be achieved.

Preferably, the correction conditions are expressed by N simultaneous equations derived from conditions under which a DC component of the spatial frequency is preserved and the differential coefficients of the power spectrum up to (N−1)-th order become substantially zero.

In order to determine the density correction coefficients respectively for the N correction recording elements (there are N unknown numbers), N simultaneous equations are obtained by using conditions for preserving the DC component and conditions whereby the differential coefficients up to the (N−1)-th order become substantially zero. By solving these simultaneous equations, it is possible to determine all of the unknown numbers (the N unknown numbers).

Furthermore, by satisfying conditions whereby the higher order differential coefficients become substantially zero, the degree of increase in the power spectrum is further restricted with respect to increase in the frequency from the origin point of the frequency range, and the intensity of the low-frequency component is kept to a lower value.

Preferably, the recording characteristics include recording position error.

According to this aspect of the present invention, it is possible to achieve effective correction of density non-uniformities due to the recording position error.

Preferably, the virtual dot is arranged at a midpoint between adjacent two of the dots recorded by the correction recording elements. According to this aspect of the present invention, it becomes easy to perform calculations.

Preferably, the virtual dot is arranged at a position that is determined in accordance with densities and positions of adjacent two of the dots recorded by the correction recording elements.

Preferably, the virtual density of the virtual dot is determined in accordance with densities of adjacent two of the dots recorded by the correction recording elements and an interval between the adjacent two of the dots.

According to these aspects of the present invention, it is possible to adopt a mode in which the positions of the virtual dots are determined in accordance with the densities and positions of the adjacent dots, or it is possible to adopt a mode in which the virtual densities are determined in accordance with the densities of the adjacent dots and the interval between the adjacent dots.

In order to attain the aforementioned object, the present invention is also directed to an image recording method of recording an image on a recording medium while moving the recording medium and a recording head that has a plurality of recording elements relatively to each other by conveying at least one of the recording medium and the recording head, the method comprising: a characteristics information acquisition step of acquiring information that indicates recording characteristics of the plurality of recording elements; a correction object determination step of selecting from the plurality of recording elements a correction object recording element to be corrected, the correction object recording element having the recording characteristics that cause density non-uniformity in the image; a correction range setting step of selecting from the plurality of recording elements N correction recording elements to be used for correcting an output density, N being an integer not less than 2; a virtual dot setting step of setting a virtual dot to be arranged between dots recorded by the selected correction recording elements and determining a virtual density of the virtual dot for calculation purposes, the virtual dot being set for calculation purposes and not actually recorded on the recording medium; a correction coefficient determination step of calculating the density non-uniformity caused by the virtual dot and the recording characteristics of the correction object recording element and then determining density correction coefficients for the N correction recording elements in accordance with correction conditions that reduce a low-frequency component of a power spectrum representing spatial frequency characteristics of the calculated density non-uniformity; a correction processing step of performing calculation for correcting the output density by using the density correction coefficients determined in the correction coefficient determination step; and a drive control step of controlling the plurality of recording elements in accordance with the output density corrected in the correction processing step.

In order to attain the aforementioned object, the present invention is also directed to a method of determining density correction coefficients, comprising: a characteristics information acquisition step of acquiring information that indicates recording characteristics of a plurality of recording elements arranged in a recording head, the plurality of recording elements recording an image on a recording medium; a correction object determination step of selecting from the plurality of recording elements a correction object recording element to be corrected, the correction object recording element having the recording characteristics that cause density non-uniformity in the image; a correction range setting step of selecting from the plurality of recording elements N correction recording elements to be used for correcting an output density, N being an integer not less than 2; a virtual dot setting step of setting a virtual dot to be arranged between dots recorded by the selected correction recording elements and determining a virtual density of the virtual dot for calculation purposes, the virtual dot being set for calculation purposes and not actually recorded on the recording medium; and a correction coefficient determination step of calculating the density non-uniformity caused by the virtual dot and the recording characteristics of the correction object recording element and then determining density correction coefficients for the N correction recording elements in accordance with correction conditions that reduce a low-frequency component of a power spectrum representing spatial frequency characteristics of the calculated density non-uniformity.

Furthermore, it is also possible to provide an image processing method which incorporates a correction processing step of performing a calculation for correcting the output density by using density correction coefficients determined by the above-described method of determining density correction coefficients.

In order to attain the aforementioned object, the present invention is also directed to a computer readable medium storing instructions causing a computer to perform the steps of the above-described method of determining density correction coefficients. Furthermore, it is also possible to store in the computer readable medium instructions causing a computer to perform not only the steps of the above-described method of determining density correction coefficients but also the steps of an image processing method including a correction processing step.

The computer readable medium according to this aspect of the present invention may be used for operating a central processing unit (CPU) incorporated into a printer and it may also be used for a computer system, such as a personal computer.

Furthermore, the computer readable medium may contain stand-alone applicational software, or it may include a part of another application, such as image editing software. This computer readable medium can be a CD-ROM, a magnetic disk, or other information storage medium (an external storage device), and the computer readable medium may be provided to a third party in the form of such an information storage medium, or a download service for the program may be offered by means of a communications circuit, such as the Internet.

According to the present invention, it is possible to correct density non-uniformities caused by variations in the recording characteristics of recording elements, with high accuracy, and hence images of high quality can be formed.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Correction Principles

Firstly, the principles of correction are hereby described. In the correction processing for density non-uniformities according to an embodiment of the present invention described here, when correcting the depositing position error of a particular nozzle, correction is performed by using N pieces of nozzles including the particular nozzle and the nozzles surrounding the particular nozzle. As described in detail below, the greater the number of nozzles N used for correction, the greater the correction accuracy.

Figure 1:
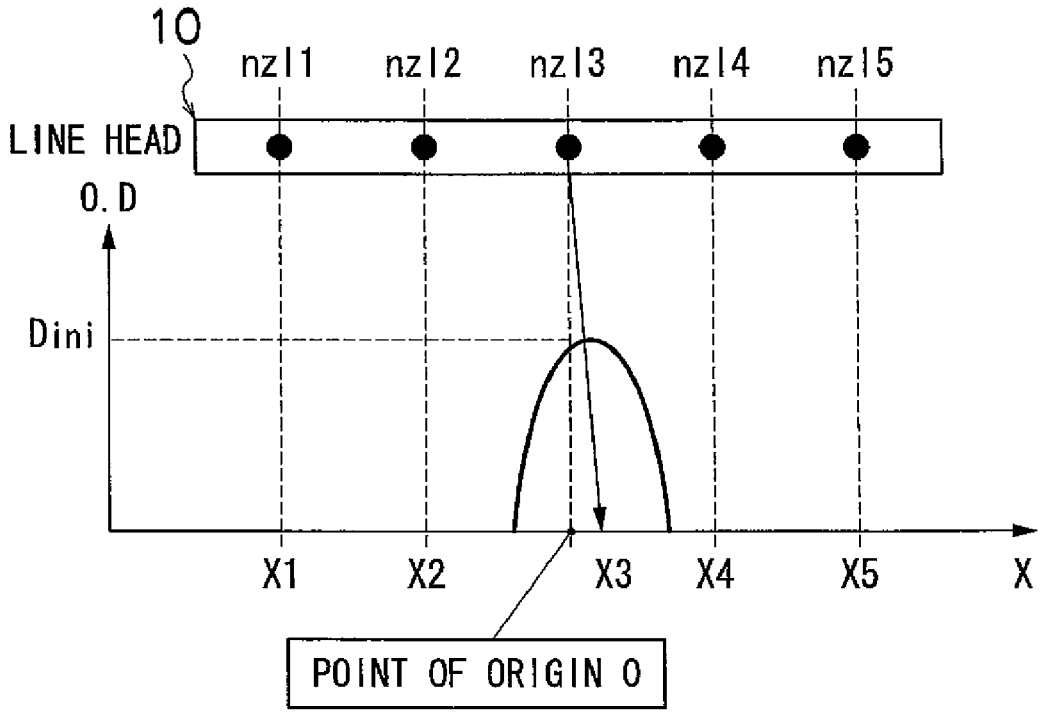
FIG. 1 is an illustrative diagram showing a density profile before correction of density non-uniformity according to an embodiment of the present invention.

FIG. 1 is a diagram showing a state before correction. In FIG. 1, the third nozzle (nzl3) from the left in a line head 10 (which is equivalent to a "recording head") has a depositing position error, and hence the depositing position is displaced from the ideal depositing position (the origin O) in the rightward direction in the diagram (the main scanning direction indicated by the X axis in FIG. 1). Furthermore, the graph shown in the bottom part of FIG. 1 indicates the density profile in the nozzle column direction (main scanning direction), obtained by averaging the print density produced by the droplets ejected from each nozzle in the conveyance direction of the recording medium (the sub-scanning direction). Here, since correction relating to the printing by the nozzle nzl3 is considered in FIG. 1, the density outputs of the nozzles other than the nozzle nzl3 are not shown in FIG. 1. The horizontal axis (X axis) represents the position in the main scanning direction, and the vertical axis represents the optical density (O. D.).

The initial output density of each of the nozzles nzl1 to nzl5 is $D_i=D_{INI}$ (where i is the nozzle number of 1, 2, 3, 4 or 5, and $D_{INI}$ is a uniform value), the origin O is set at the ideal depositing position of the nozzle nzl3, and the depositing position of each of the nozzles nzl1 to nzl5 is $X_i$.

Here, $D_i$ represents the output optical density of the nozzle when averaged physically in the recording medium conveyance direction, and corresponds to the averaged density data D(i,j) of pixels (where i is the nozzle number, and j is the pixel number in the conveyance direction of the recording medium) that is calculated as an average with respect to "j".

As shown in FIG. 1, the depositing position error of the nozzle nzl3 is represented by the divergence of the density output of the nozzle nzl3 (thick line) from the origin point O. The correction of this divergence in the output density is described below.

Figure 2:
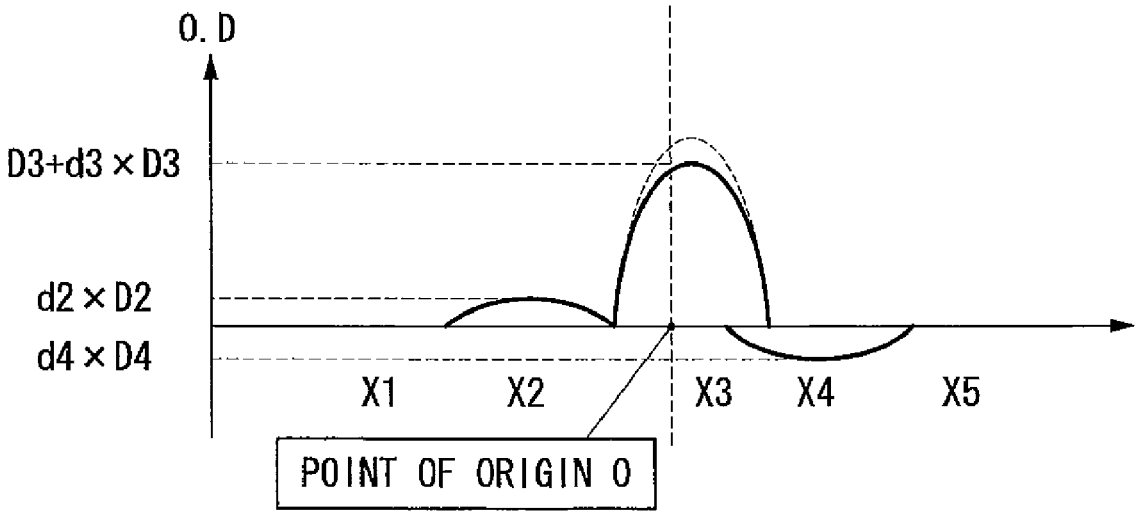
FIG. 2 is an illustrative diagram showing a state after correction of density non-uniformity according to an embodiment of the present invention.

FIG. 2 is a diagram showing a state after correction. Here, the density output for the nozzle nzl3 is shown together with the correction components. In the case of FIG. 2, the number of nozzles used in correction is N=3, and the nozzles nzl2, nzl3 and nzl4 are weighted (multiplied) with density correction coefficients d2, d3 and d4, respectively. The density correction coefficients di described here are defined as $D'_i=D_i+d_i\times D_i$, where $D'_i$ are the output densities after correction.

In the present embodiment, the density correction coefficient of each nozzle is determined so as to minimize the visibility of the density non-uniformity.

It has been known that the visibility of a spatial structure, such as density non-uniformity, can be evaluated on the basis of the spatial frequency characteristics (see, for example, "Application of Fourier Analysis to the Visibility of Gratings", Journal of Physiology, 197, 551 to 566 (1968) F. W. Campbell and J. G. Robson 1967, "Noise Perception in Electrophotography", Journal of Applied Photographic Engineering 5: 190 to 196 (1979) R. P. Dooley ad R. Shaw), and it is clear that human vision has high sensitivity to low-frequency components, and this sensitivity declines as the frequency increases. In other words, it is suitable to use the low-frequency energy of the spatial frequency characteristics as a measure of the visibility of a density non-uniformity. Therefore, in the present embodiment, the density correction coefficient for each nozzle is determined so as to minimize the low-frequency component of the power spectrum.

Calculation of Density Correction Coefficients

Figure 3:
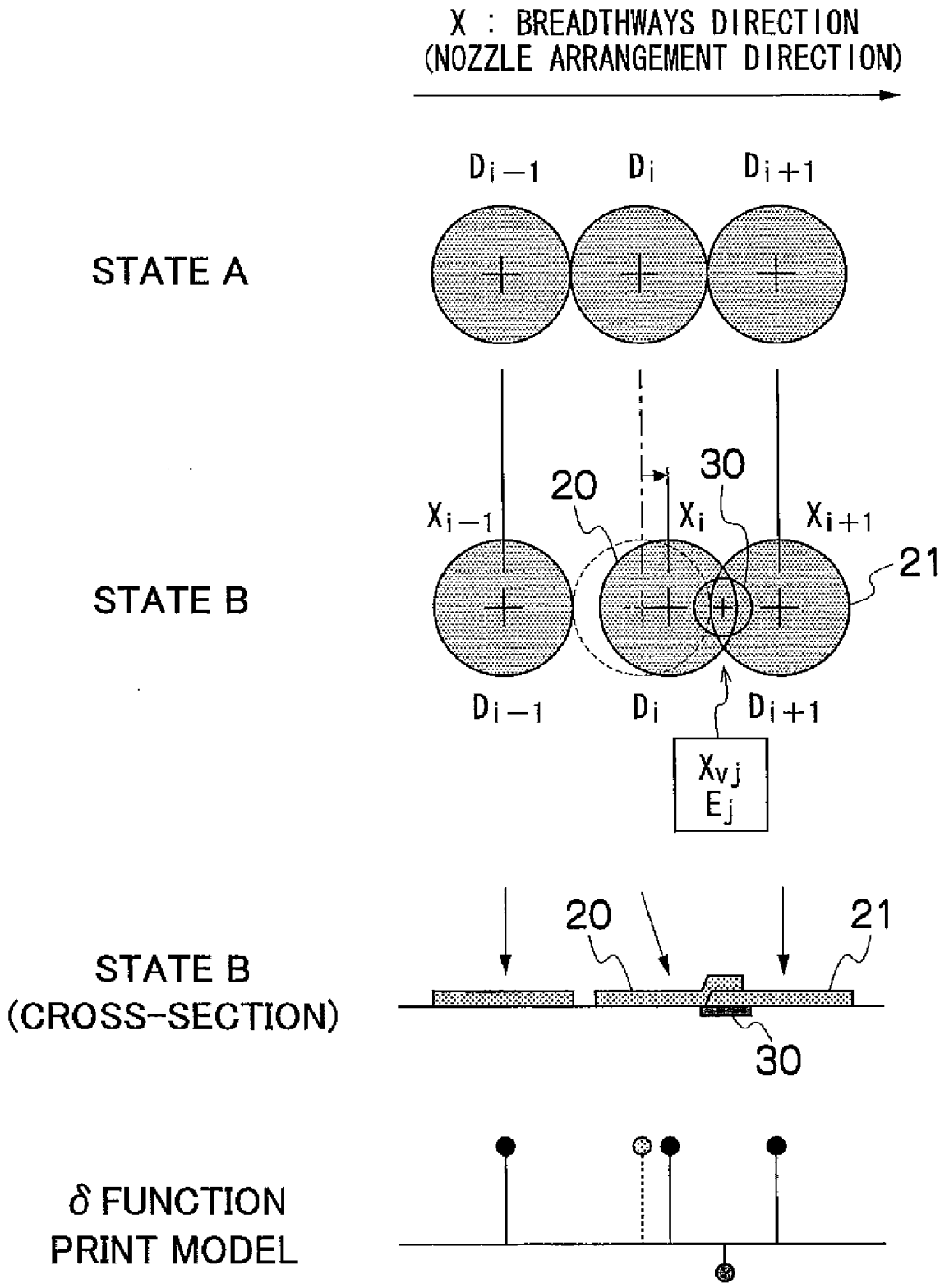
FIG. 3 is an illustrative diagram for showing an example where a virtual deposited droplet having a negative density is set in an overlapping portion of adjacent deposited droplets.

Next, the method of determining density correction coefficients will be described. FIG. 3 is an illustrative diagram showing the method of determining the density correction coefficients. The state A of FIG. 3 shows an example of the arrangement of dots (deposited droplets) created by ideal droplet ejection which involves no displacement of the depositing positions. In the state A of FIG. 3, the direction indicated by arrow X indicates the breadthways direction of the line head (main scanning direction), in other words, the direction of arrangement of the nozzles.

The state B of FIG. 3 shows an example of an actual deposited dot arrangement in which depositing position displacement has occurred due to variation in the ejection characteristics of the nozzles, and FIG. 3 ("STATE B (CROSS-SECTION)") also shows a schematic view of the ink thickness of the deposited droplets in the state B.

If the mutually adjacent deposited droplets do not overlap with each other, then it is possible to achieve a density profile D(x) which incorporates the error characteristics of the respective nozzles. The density profile D(x) can be calculated in the similar manner to Japanese Patent Application Publication No. 2006-347164, by means of the following equation:

$$D(x) = \sum_i D_i \cdot z(x - x_i), \tag{1}$$

where x is a position on a recording medium in breadthways direction, $x_i$ is a depositing position of an ejected droplet, $D_i$ is a nozzle output density and z(x) is a standard density profile (x=0 is the center of gravity).

However, as shown in the state B of FIG. 3, if the mutually adjacent deposited droplets (reference numerals 20 and 21) overlap with each other, then in the overlapping portion, the density is not linear with respect to the ink thickness (the total surface area of the two droplets in the overlapping portion), and the density of the mutually adjacent dots cannot be found by a simple sum calculation (linear calculation). The actual density of the overlapping portion is lower than the density obtained by a simple sum calculation. Therefore, the density profile D(x) cannot be calculated by the equation (1).

In view of this, in the present embodiment, a density profile in the breadthways direction of the head (the nozzle arrangement direction) which incorporates the error characteristics of the respective nozzles is defined as shown in the following formula (equation (2)) below, by taking account of the reduction in density caused by the non-linearity of the density in the overlapping portions of the deposited droplets, and providing virtual deposited droplets 30 which are not actually deposited but are used for calculational purposes, at the positions where the deposited droplets overlap ($X_{vj}$ in the state B of FIG. 3) (the density $E_j$ may also take a negative value). The density profile D'(x) can be obtained as follows:

$$D'(x) = \sum_i D_i \cdot z(x - x_i) + \sum_j E_j \cdot w(x - x_{vj}), \tag{2}$$

where x is a position on the recording medium in breadthways direction, $x_i$ is a depositing position of an ejected droplet, $D_i$ is a nozzle output density, z(x) is a standard density profile (x=0 is the center of gravity), $x_{vj}$ is a depositing position of a virtual deposited droplet, $E_j$ is an output density of a virtual deposited droplet and w(x) is a standard density profile of a virtual deposited droplet (x=0 is the center of gravity).

Since the density $E_j$ (which corresponds to the "virtual density") is preferably changed in accordance with the amount of overlap between the mutually adjacent deposited droplets, then the density $E_j$ of the virtual deposited droplet may be expressed as a function of the densities of the mutually adjacent deposited droplets and the interval between same. Furthermore, the position $x_{vj}$ may be expressed as a function of the densities and the positions of the mutually adjacent deposited droplets.

More specifically, the density $E_j$ and the position $x_{vj}$ are respectively expressed as follows:

$$E_j = g(D_j, D_{i+1}, x_{i+1} - x_i) \tag{3}$$ and $$x_{vj} = h(D_i, D_{i+1}, x_{i+1}, x_i) \tag{4}.$$

Figure 4:
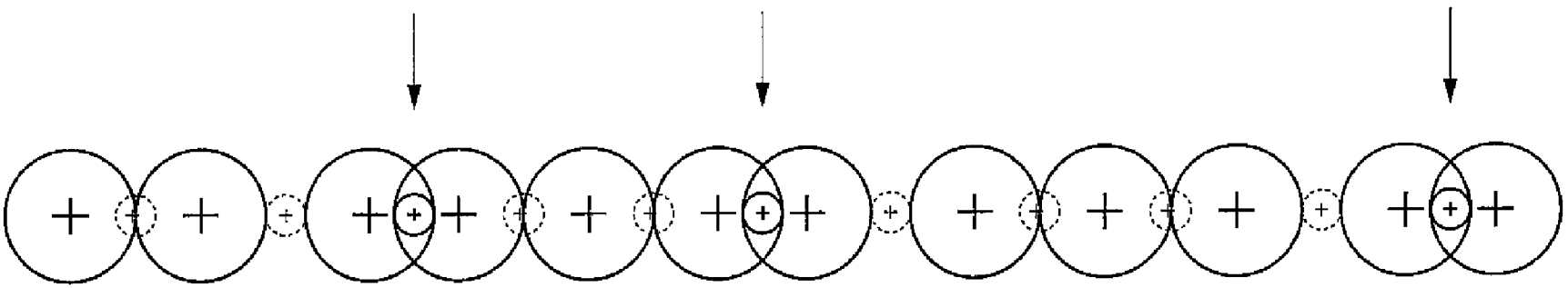
FIG. 4 is a diagram showing an example of setting a virtual deposited droplet.

In an actual apparatus, a data table corresponding to the functions in equation (3) and equation (4) may be used. The values in the table used to determine the value of $E_j$ (the function g expressed in equation (3)) are determined on the basis of a combination of the density and the interval of the adjacent deposited droplets, and the value is set to "0" in a position where there is no overlap between the deposited droplets. In other words, as shown in FIG. 4, virtual deposited droplets (indicated by the solid circles) having a density of $E_j$ ($\neq 0$) are created only at positions where overlap occurs between the mutually adjacent deposited droplets (the positions indicated by the arrow symbols in FIG. 4), and on the other hand, virtual deposited droplets (indicated by the dotted circles) are not created at positions between the adjacent deposited droplets where no overlap occurs.

The virtual deposited droplets are not observed in actual printing, but rather are set as virtual points for the purposes of calculation. Various possible methods can be used for setting the virtual deposited droplets. FIG. 4 shows a most simplified example in which the dot size created by an actual ejected droplet is uniform and a virtual deposited droplet is arranged at a central position between mutually adjacent deposited droplets in an overlapping portion; however, it is also possible to take into account variations in the dot size, and the like, by appropriately setting the positions and density of these virtual deposited droplets. By this means, it is possible to correspond to a variety of situations including a situation where there are variations in the dot size.

The density of the virtual deposited droplets can basically be determined in accordance with the position and the size of the mutually adjacent deposited droplets (actual deposited droplets), as well as the density and amount of overlap (deposited droplet interval) of the mutually adjacent deposited droplets. However, since the amount of overlap varies with the size of the adjacent deposited droplets, then it is possible simply to calculate the density of the virtual deposited droplets beforehand on the basis of the size of the adjacent deposited droplets, and to store this information in a look-up table for subsequent use in calculation.

Alternatively, to achieve a more accurate calculation, it is also possible, for instance, to adjust the virtual deposited droplets on the basis of the positions of the mutually adjacent deposited droplets and their respective sizes. For example, it is possible to take into account the center of gravity and to shift the virtual deposited droplet from the central point toward the side of the larger deposited droplet (arrange the virtual deposited droplet not at the central point but at a point nearer to the larger deposited droplet).

In this way, in the density profile which is defined in equation (2), the non-linearity of the density caused by overlapping between the deposited droplets is corrected by introducing virtual deposited droplets (density $E_j$).

In the present embodiment, the solution $D_i$ is obtained as follows. Firstly, the formula expressed by the equation (2) above is subjected to Fourier transform to obtain the function T'(f) as follows:

$$T'(f) = \int_{-\infty}^{\infty} D'(x) \cdot e^{i \cdot f \cdot x} dx. \quad (5)$$

Next, the power spectrum of the function T'(f) is obtained as follows:

$$\text{Power Spectrum} = \int T'(f)^2 df \quad (6).$$

Then, the solution $D_i$ is derived as the value which achieves the minimum low-frequency component in the power spectrum equation expressed by the equation (6). A specific calculation example is given below, but the solution $D_i$ is found by establishing simultaneous equations in which the differential coefficients (first-order, second-order, . . . ) at f=0 in T'(f) are zero. The solution for $D_i$ obtained by this method corresponds to a density correction coefficient.

Description of Virtual Deposited Droplet

The effects of introducing virtual deposited droplets in this way is described in detail below.

Firstly, the reflection density of a dot formed by one ejected droplet is calculated in a manner described below. The transmission density and the reflection density are expressed as follows:

$$D_T = C_1 \cdot d,\ D_R = D_T^{C_2} \quad (7),$$

where $D_T$ is a transmission density, $D_R$ is a reflection density, $C_1$ and $C_2$ are constants, and d is a color material density (indicates the coloring material density if the ink thickness is uniform, and indicates the ink thickness if the coloring material density is uniform). From this equation (7), the following equation can be derived:

$$D_R = C_3 \cdot d^{C_2} \quad (8),$$

where $C_3$ is a constant.

Figure 5:
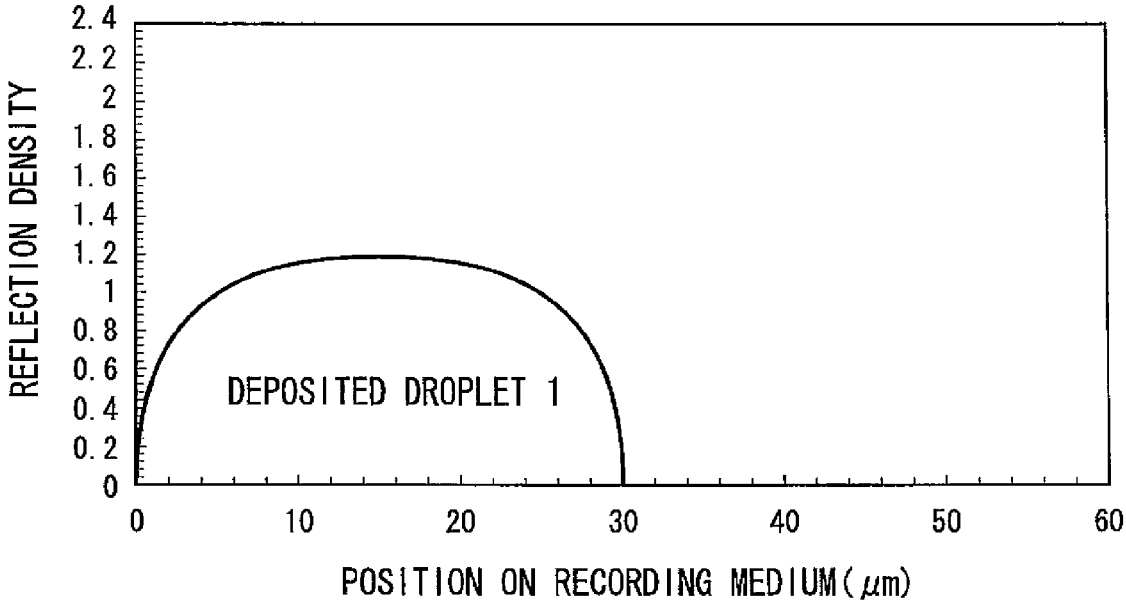
FIG. 5 is a graph showing a reflection density profile of one dot (one deposited droplet)
Figure 6:
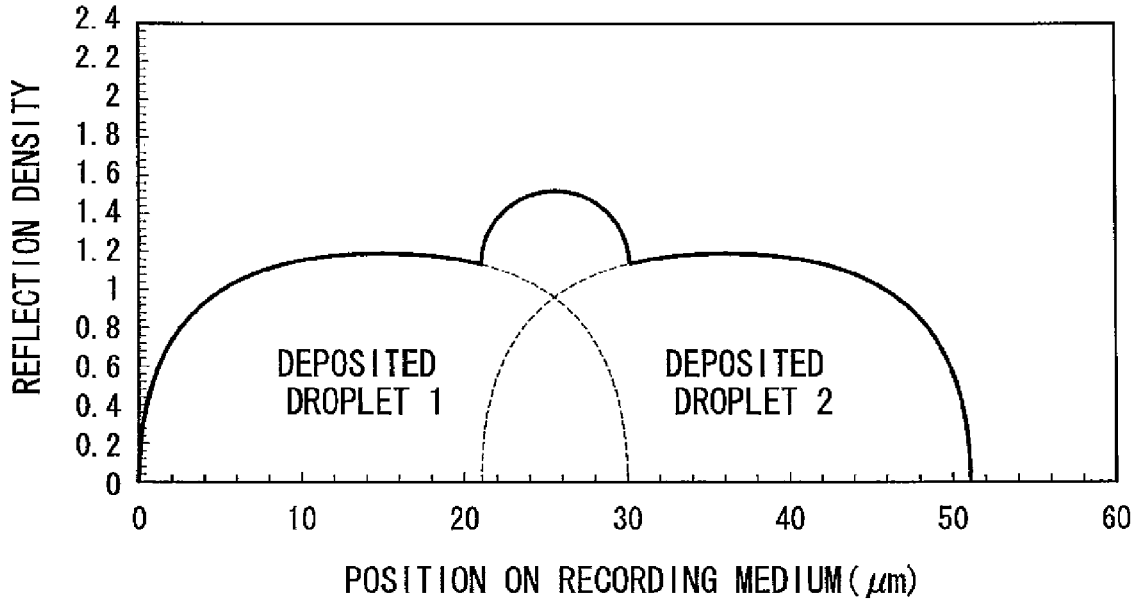
FIG. 6 is a graph showing the reflection density profile of two dots which are mutually adjacent and have an overlapping portion.

If the ink coloring material density is calculated by using the equation (8) above, based on a hemispherical model (namely, a "hemispherical ink density model", which is different to the "hemispherical reflection density model" which is described below), then the results shown in FIG. 5 and FIG. 6 are obtained.

FIG. 5 is a diagram showing the reflection density profile in the case of one liquid droplet; the horizontal axis indicates the position on the recording medium and the vertical axis indicates the reflection density. FIG. 6 is a diagram showing the density profile in a case where two droplets overlap partially with each other. The calculation results shown in FIG. 5 and FIG. 6 represent the density profile of actual deposited droplets, in a substantially faithful fashion.

Figure 7:
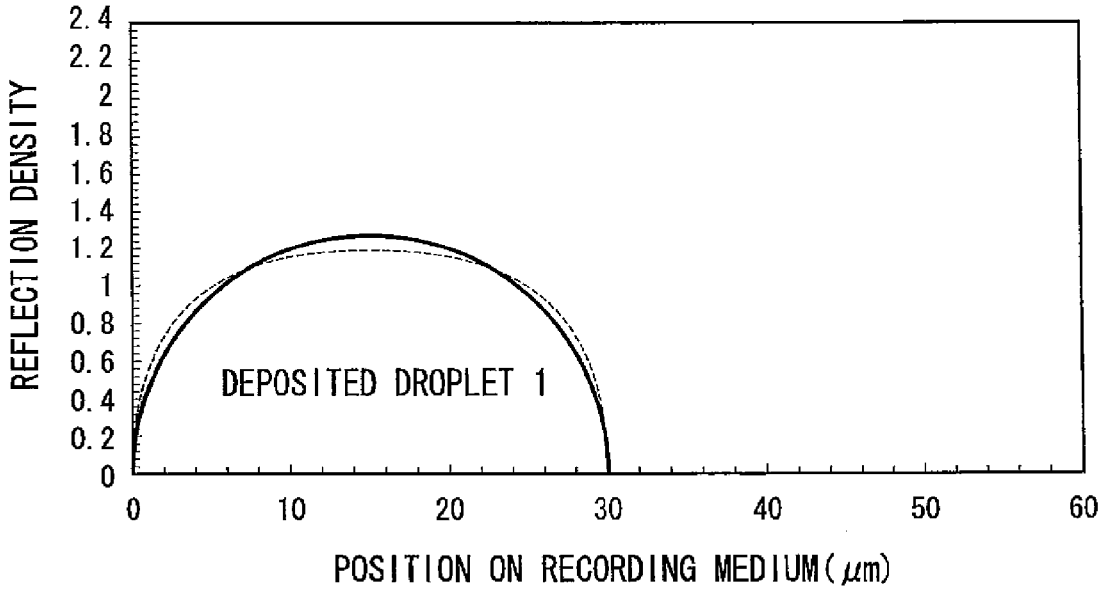
FIG. 7 is a graph showing an example where the reflection density profile in FIG. 5 is approximated by a "hemispherical reflection density model"
Figure 8:
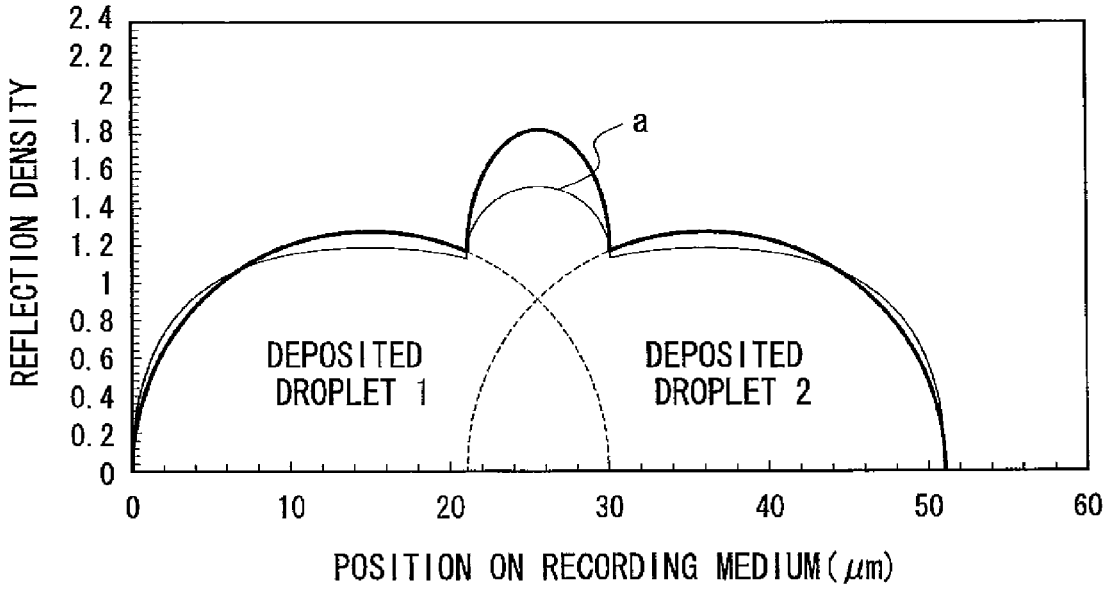
FIG. 8 is a graph showing an example where the reflection density profile in FIG. 6 is approximated by a "hemispherical reflection density model"

If the actual reflection density profile shown in FIG. 5 and FIG. 6 is approximated by the "hemispherical reflection density model" as described in Japanese Patent Application Publication No. 2006-347164, in order to simplify the calculation of density non-uniformity correction values (density correction coefficients) in relation to this density profile, then the results shown in FIG. 7 and FIG. 8 are obtained.

FIG. 7 is a diagram showing an approximation of the actual reflection density profile for one liquid droplet shown in FIG. 5, on the basis of a hemispherical model (hemispherical reflection density model). FIG. 8 is a diagram showing a case where a hemispherical reflection density model is applied to the actual reflection density profile shown in FIG. 6, in relation to two liquid droplets. In FIG. 8, the overlapping portion between two deposited droplets is approximated by a simple sum calculation.

FIG. 8 also shows the actual reflection density profile shown in FIG. 6 (indicated by reference numeral "a" in FIG. 8), for the purposes of comparison. As shown in FIG. 8, if a simple sum calculation is used to calculate the overlapping portion between two droplets by approximation using a hemispherical reflection density model, then there arises a big difference between the calculated density profile and the actual reflection density profile. This description relates to two liquid droplets, but the same applies to cases where two or more liquid droplets are deposited continuously, and if a simple sum calculation is applied to the overlapping portions between the dots, then a large difference occurs with respect to the actual reflection density profile.

Figure 9:
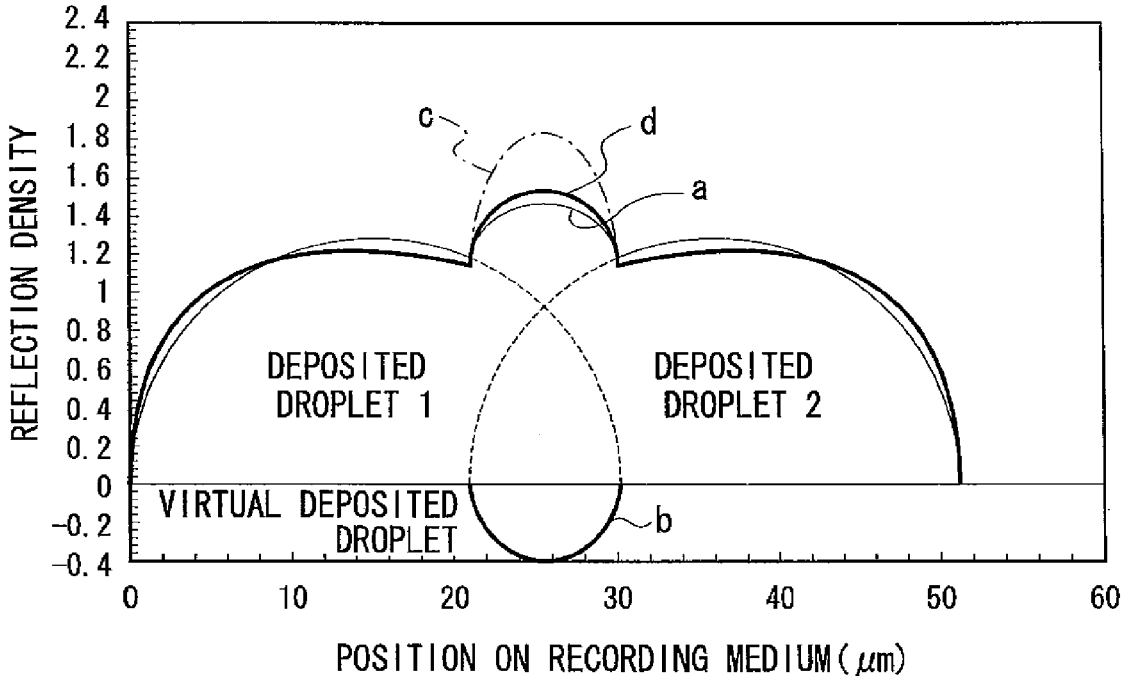
FIG. 9 is a graph showing a reflection density profile calculated by introducing a virtual deposited droplet.

Therefore, in the present embodiment, virtual deposited droplets which correct the density of the overlapping portions are introduced as shown in FIG. 9, in order that the reflection density calculation of the overlapping portions between deposited droplets approaches the actual values (FIG. 6), while maintaining the simplicity of the calculation. FIG. 9 shows an example in which a virtual deposited droplet (indicated by reference numeral "b" in FIG. 9) having a negative density is arranged at a central position (mid-point) between the first dot (deposited droplet 1) and the second dot (deposited droplet 2), but various settings are possible for the position and density of the virtual deposited droplets.

In FIG. 9, the actual reflection density profile (reference symbol "a") shown in FIG. 6 and the profile (reference symbol "c") created by the hemispherical reflection density model (simple sum) shown in FIG. 8 are also depicted for the purposes of comparison.

In FIG. 9, by using a virtual deposited droplet having a negative density, the overall density profile (reference symbol "d") which also includes the density of the virtual deposited droplet approaches the actual reflection density profile (reference symbol "a"), and the density error is thereby improved in comparison with the example shown in FIG. 8.

Even in a case where a plurality of deposited droplets are mutually overlapping, by introducing virtual deposited droplets in this way, then it is possible to approach the actual reflection density profile by means of a simple calculation method. In particular, a calculation method of this kind is effective when calculating the power spectrum as defined in equation (3) (where a Fourier transform is necessary). Furthermore, since the reflection density of deposited droplets including actual deposited droplets and virtual deposited droplets is calculated by a sum calculation (linear coupling), then the respective droplet ejection densities can be substituted by a δ function, and in this case, the calculation can be simplified yet further.

The actual reflection density of the portion of overlap between two droplets is calculated by the following equation:

$$D_R = C_4 \cdot \left( C_1 \cdot \frac{2}{\pi r^2} \cdot \sqrt{1 - \left(\frac{x - x_{o1}}{r}\right)^2} + C_2 \cdot \frac{2}{\pi r^2} \cdot \sqrt{1 - \left(\frac{x - x_{o2}}{r}\right)^2} \right)^{C_3}, \tag{9}$$

where r is a radius of a deposited droplet under the hemispherical reflection density model, $x_{o1}$ is a central position of the deposited droplet 1, $x_{o2}$ is a central position of the deposited droplet 2, $C_1$ is a density of the deposited droplet 1, $C_2$ is a density of the deposited droplet 2, and $C_3$ and $C_4$ are constants.

On the other hand, the reflection density approximation calculation according to the present embodiment, which uses virtual deposited droplets, is calculated by the following equation:

$$D_R = C_1 \cdot \frac{2}{\pi r^2} \cdot \sqrt{1 - \left(\frac{x - x_{o1}}{r}\right)^2} + C_2 \cdot \frac{2}{\pi r^2} \cdot \sqrt{1 - \left(\frac{x - x_{o2}}{r}\right)^2} + E \cdot \frac{2}{\pi r_v^2} \cdot \sqrt{1 - \left(\frac{x - x_{ov}}{r_v}\right)^2}, \tag{10}$$

where r is a radius of a deposited droplet under hemispherical reflection density model, $r_v$ is a radius of a virtual deposited droplet under the hemispherical reflection density model, $x_{o1}$ is a central position of the deposited droplet 1, $x_{o2}$ is a central position of the deposited droplet 2, $x_{ov}$ is a central position of a virtual deposited droplet, E is a density of a virtual deposited droplet (actual value is determined in advance by calculating equation (9) and equation (10)), $C_1$ is a density of the deposited droplet 1, $C_2$ is a density of the deposited droplet 2, and $C_3$ and $C_4$ are constants.

Concrete Calculation Example

As also described in Japanese Patent Application Publication No. 2006-347164, the density profile of the image is the sum of the density profiles of the deposited droplets printed by the respective nozzles. The print model represents the printing performed by a nozzle (the density profile printed by one nozzle). The print model is represented separately by a nozzle output density $D_i$ and a standard density profile z(x). Similarly, the model of the virtual deposited droplets is also represented separately by a density Ei of the virtual deposited droplet and a standard density profile w(x).

Although the standard density profiles z(x) and w(x) have a limited spread equal to the dot diameter in strict terms, the important element is the central position (depositing position) of the density profile of each deposited droplet and the spread of the density profile is a secondary factor, if the correction of positional errors is considered to be a problem of balancing divergences in the density. Hence, an approximation that converts the profile by means of a δ function is appropriate. If this type of standard density profile (using a δ function) is adopted, then the arithmetical operation becomes easier.

In FIG. 3 (the bottom of FIG. 3 which is denoted with "δ function print model"), a δ function print model is shown which includes actual deposited droplets and a virtual deposited droplet. FIG. 3 shows a state where a positive density value is assigned to the actual deposited droplets, and a negative density value is set for the virtual deposited droplet. If a δ function model is applied to the standard density profiles z(x) and w(x) in the equation defined in the equation (2), then the equation (3) is expressed as follows:

$$T'(f) = \int \sum_i (D_i \cdot \delta(x - x_i)) \cdot e^{ifx} dx + \int \sum_j (E_j \cdot \delta(x - x_{vj})) \cdot e^{ifx} dx = \sum_j D_i \cdot e^{ifx} + \sum_j E_j \cdot e^{ifx_{vj}} \tag{11}$$

In this case, $E_j$ is calculated in advance from the densities of the deposited droplets on the left and right-hand side, and $x_{vj}$ is calculated, for example, as the central point between mutually adjacent deposited droplets, in other words, $(x_i + x_{i+1})/2$.

Minimizing the visibility of the density non-uniformity corresponds to minimizing the low frequency component of the power spectrum obtained by the equation (6), and this can be approximated arithmetically by setting the differential coefficients (first-order, second-order, . . . ) at f=0 in T'(f), to zero. Here, since the respective density correction coefficients are determined in respect of N nozzles which are used for correction, then there are N unknown values of $D_i$, and therefore, if a preservation condition for the DC component is also included, then all of the (N) unknown values $D_i$ are determined by adopting a condition where the differential coefficients up to the (N−1)-th order are zero.

In other words, the following simultaneous equations (12) are obtained by setting the differential coefficients (first-order, second-order, . . . ) at f=0 in T'(t) in equation (11) to zero.

$$\begin{aligned} &\sum_i D_i + \sum_j E_j = 1 \\ &\sum_i x_i \cdot D_i + \sum_j x_{vj} \cdot E_j = 0 \\ &\sum_i x_i^2 \cdot D_i + \sum_j x_{vj}^2 \cdot E_j = 0 \end{aligned} \tag{12}$$

In other words, if these simultaneous equations (12) are expressed in a matrix format, the following equation (13) is obtained.

$$\begin{pmatrix} 1 & \dots & 1 & \dots & 1 \\ x_{-\frac{N-1}{2}} & \dots & x_0 & \dots & x_{\frac{N-1}{2}} \\ x^2_{-\frac{N-1}{2}} & \dots & x_0^2 & \dots & x^2_{\frac{N-1}{2}} \\ \vdots & \dots & \vdots & \dots & \vdots \\ x^{N-1}_{-\frac{N-1}{2}} & \dots & x_0^{N-1} & \dots & x^{N-1}_{\frac{N-1}{2}} \end{pmatrix} \begin{pmatrix} D_{-\frac{N-1}{2}} \\ \vdots \\ D_0 \\ \vdots \\ D_{\frac{N-1}{2}} \end{pmatrix} = \begin{pmatrix} 1 - \sum_j E_j \\ -\sum_j (x_{vj} \cdot E_j) \\ -\sum_j (x_{vj}^2 \cdot E_i) \\ \vdots \\ -\sum_j (x_{vj}^{N-1} \cdot E_j) \end{pmatrix} \tag{13}$$

The right-hand side of the formula shown in equation (13) is calculated in advance as a constant value. The following determinant (14) can be obtained by means of the equation (15).

$$\begin{vmatrix} 1 & \dots & 1 & \dots & 1 \\ x_{-\frac{N-1}{2}} & \dots & x_0 & \dots & x_{\frac{N-1}{2}} \\ x^2_{-\frac{N-1}{2}} & \dots & x_0^2 & \dots & x^2_{\frac{N-1}{2}} \\ \vdots & \dots & \vdots & \dots & \vdots \\ x^{N-1}_{-\frac{N-1}{2}} & \dots & x_0^{N-1} & \dots & x^{N-1}_{\frac{N-1}{2}} \end{vmatrix} \tag{14}$$

$$\prod_{h>k}(x_h - x_k) \tag{15}$$

Consequently, the values of $D_i$ can be obtained by using Cramer's rule.

In this way, it is possible to determine the density correction coefficient under the conditions where the differential coefficient of the power spectrum becomes zero at the point of origin. As the number of nozzles N used in the correction increases, it becomes easier to adjust the higher-order differential coefficients to be zero, and hence, the low-frequency energy becomes smaller and the visibility of non-uniformities is reduced yet further.

In the present embodiment, the conditions where the differential coefficients become zero at the origin are used, but if the differential coefficients become sufficiently small values compared to the differential coefficients before the correction (such as 1/10 of the values before the correction), rather than being set completely to zero, it is still possible to make the low-frequency components of the power spectrum of the density non-uniformity sufficiently small. In other words, from the viewpoint of achieving conditions where the low-frequency components of the power spectrum are reduced to extent by which density non-uniformities become invisible, it is acceptable that the differential coefficients of the power spectrum at the origin are set to sufficiently small values (approximately 0), and that the range of each differential coefficient after correction can be set up to 1/10 of the absolute value of the differential coefficient before correction.

The foregoing description relates to the method of determining density correction coefficients relating to one particular nozzle (e.g., the nozzle nzl3 in FIG. 1). In actual practice, all of the nozzles in the head have some degree of depositing position errors, and therefore, it is desirable that corrections are performed in respect of all of these depositing position errors.

In other words, the aforementioned density correction coefficients for the surrounding N nozzles are determined with respect to each nozzle. Since the equations for minimizing the power spectra, which are described above and used when determining the density correction coefficients, are linear, then it is possible to superpose the equations for each nozzle. Therefore, the total density correction coefficient for a nozzle is determined by finding the sum of the density correction coefficients obtained as described above.

More specifically, if the density correction coefficient for a nozzle i in relation to the positional error of a nozzle k is set to be d(i, k), then the value of this d(i, k) is determined by the solution $D_i$ of equation (13), and the total density correction coefficient $d_i$ for the nozzle i is obtained by linear combination of d(i, k) as the following equation (16).

$$d_i = \sum_k d(i, k) \tag{16}$$

In the present embodiment, d(i, k) is accumulated for the index k assuming that the depositing position errors of all of the nozzles are to be corrected, but it is also possible to adopt a composition in which a certain value ΔX_thresh is set previously as a threshold value, and correction is performed selectively by setting as objects for correction only those nozzles that have a depositing position error exceeding this threshold value of ΔX_thresh.

As stated above, the accuracy of correction is improved if the value of the number of nozzles N used for the correction is increased, but this also increases the breadth of change of the density correction coefficients and may lead to disruption of the reproduced image. Therefore, desirably, a limit range (a lower limit d_min to an upper limit d_max) is set for the correction coefficients in order to prevent the occurrence of image disruption, and the value N is set in such a manner that the total density correction coefficient determined by the above-described equation (16) comes within this limit range. In other words, the value N is set in such a manner that the relationship of $d_min < d_i < d_max$ is satisfied.

From experimental observation, it was revealed that image disruption does not occur provided that $d_min \geqq -1$ and $d_max \leqq 1$.

Processing Sequence for Calculating Density Correction Coefficient

Figure 10:
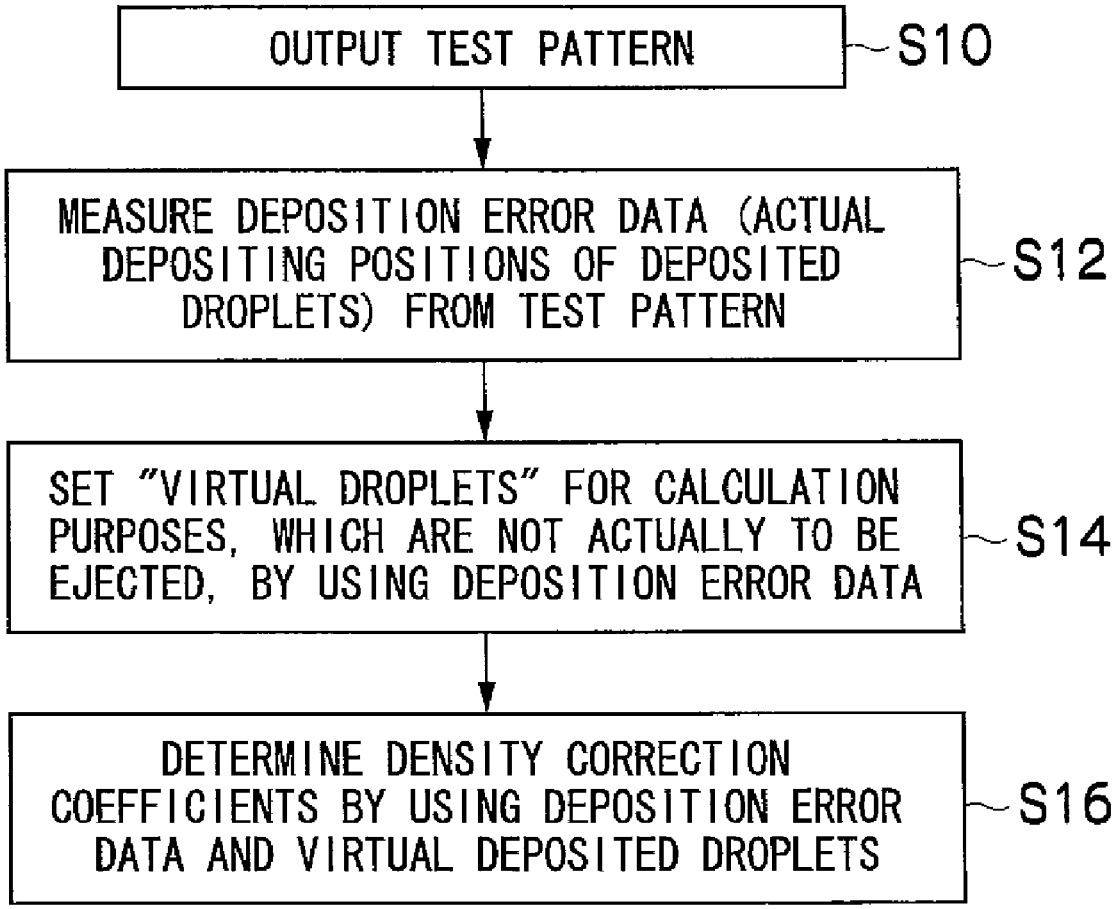
FIG. 10 is a flowchart showing a sequence for calculating density correction coefficients according to an embodiment of the present invention.

FIG. 10 is a flowchart showing a procedure for determining the density correction coefficients (correction data). The density correction coefficients do not have to be calculated each time an image is output, but rather it is sufficient to calculate them only when the ejection characteristics of the head have changed (for example, when the apparatus is manufactured (shipped)). Moreover, the processing sequence shown in FIG. 10 may be started under any one of the following conditions.

Namely, the processing shown in FIG. 10 starts if either: (a) an automatic checking device (sensor), which monitors the print result, judges that a non-uniformity streak has occurred in the printed image; or (b) a human observer judges that a non-uniformity streak has occurred in the printed image upon looking at the printed image, and performs a prescribed operation (such as inputting a command to start the updating process); or (c) a previously established update timing has been reached (the update timing can be set and judged by means of time management based on a timer, or the like, or operational record management based on a print counter).

As shown in FIG. 10, when calculating the density correction coefficients, firstly, a test pattern (a previously determined print pattern) for ascertaining the ejection characteristics of the head is printed (step S10).

Thereupon, the deposition error data, in other words, the depositing positions of the actual deposited droplet formed by the droplets ejected from the nozzles, are measured from the print results of the test pattern (step S12). For this measurement of the deposition error data, it is possible to use an image reading apparatus based on an image sensor (imaging element) (including a signal processing device for processing the captured image signal). The depositing positions of the actual deposited droplets are measured from the image data thus read in, and information on the depositing position error is obtained on the basis of the difference with respect to the ideal depositing positions (i.e., ideal depositing positions that are intended to be deposited in the case where there are no ejection abnormalities or the like). Furthermore, the optical density information for the deposited droplets is also measured, in addition to the depositing position information. The term "deposition error data" is used to refer generally to the various types of information (e.g., the actual depositing position information, actual depositing position error information, optical density information, and the like) acquired in this way by reading in the test pattern.

Next, the deposition error data obtained at step S12 is used to set up "virtual deposited droplets" which are used for calculation and which are not actually ejected (step S14). More specifically, the position and density of virtual deposited droplets are set as described above with reference to FIG. 3.

Thereupon, the density correction coefficients are calculated by using the deposition error data and the virtual deposited droplets (step S16). The method of calculating the density correction coefficients is as described previously.

The information relating to the density correction coefficients thus derived is stored in a rewriteable storage device, such as an EEPROM (electronically erasable and programmable read only memory), and subsequently, the most recent correction coefficients are used.

Processing Sequence for Outputting Image

Next, an image processing sequence including non-uniformity correction processing using the density correction coefficients obtained by the sequence in FIG. 10 will be described.

Figure 11:
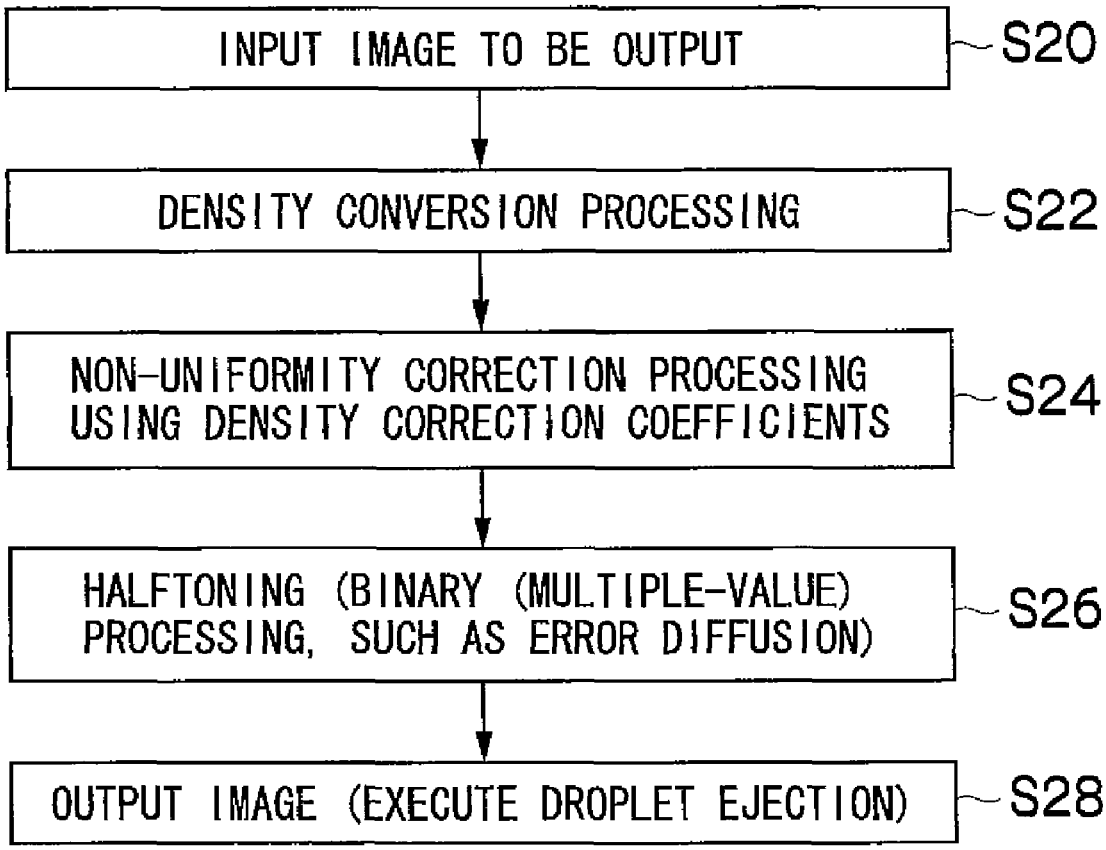
FIG. 11 is a flowchart showing a processing sequence for outputting an image.

FIG. 11 is a flowchart showing a procedure for outputting an image. When outputting (printing) an image, firstly the data of the image to be outputted (image to be printed) is input (step S20). There are no particular restrictions on the data format of the input image, but 24-bit color RGB data is input, for example. Density conversion processing based on a took-up table is carried out on this input image (step S22), thereby converting the input image into density data D(i,j) corresponding to the ink colors of the printers. Here, (i,j) indicates the position of a pixel, and hence the density data is assigned to respective pixels.

In this case, for the sake of explanation it is supposed that the image resolution of the input image matches the image resolution (nozzle resolution) of the printer. If the image resolution of the input image does not match the image resolution (nozzle resolution) of the printer, then pixel number conversion processing is carried out on the input image, in accordance with the resolution of the printer.

The density conversion processing in step S22 uses a general process, which includes under-color removal (UCR) processing, light ink distribution processing in the case of a system which uses light inks (light-colored inks of the same color), and so on.

For example, in the case of the printer having a three-ink composition comprising cyan (C), magenta (M) and yellow (Y), the image is converted into density data D(i,j) for each of the CMY inks. Alternatively, in the case of the printer having a system which also uses other inks, such as black (K), light cyan (LC), and light magenta (LM) in addition to the three inks of CMY, then the image is converted into density data D(i,j) for each of the inks including these additional ink colors.

Next, non-uniformity correction processing in use of density correction coefficients is carried out with respect to the density data D(i,j) obtained by the density conversion processing (Step S24). In this step, calculation is performed in order to multiply the density correction coefficient (ejection rate correction coefficient) $d_i$ corresponding to the related nozzle, by the density data D(i,j).

Figure 12:
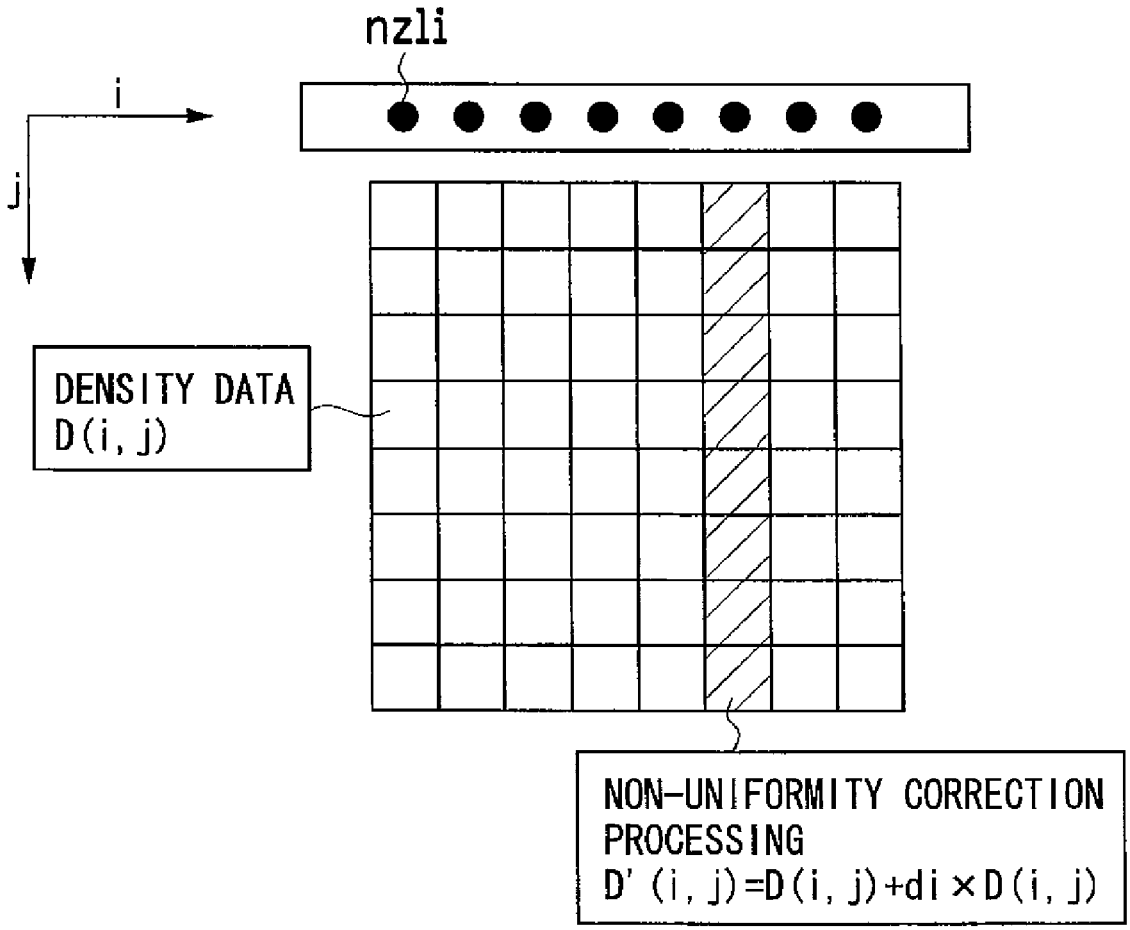
FIG. 12 is a conceptual diagram of density non-uniformity correction processing according to an embodiment of the present invention.

As shown in the schematic drawing in FIG. 12, the pixel position (i,j) on the image is specified by the position (main scanning direction position) i of the nozzle $nzl_i$, and a sub-scanning direction position j, and the density data D(i,j) is assigned to each of the pixels. If non-uniformity correction processing is carried out for a nozzle that ejects droplets for the pixel column indicated by the shading in FIG. 12, then the density data D'(i,j) after correction can be expressed by an equation of $D'(i,j)=D(i,j)+d_i \times D(i,j)$. The corrected density data D'(i,j) is thus obtained.

Thereupon, by applying a half-toning process to the corrected density data D'(i,j) (step S26 in FIG. 11), the data is converted into dot on/off signals (in binary data), or alternatively, if the dot sizes are variable, then the data is converted into multiple-value data signals including the size types (selection of dot size). There are no particular restrictions on the half-toning method used, and a commonly known binarizing (or multiple-value converting) technique, such as error diffusion, dithering, or the like, may be used.

Droplet ejection is performed by each nozzle on the basis of the binary (multiple-value) signal thus obtained, thereby outputting (recording) an image (step S28). In other words, ink ejection (droplet ejection) data for each nozzle is generated on the basis of the binary (multiple-value) data obtained by the halftoning process (step S26), and this data is used to control the ejection operation. Thereby, density non-uniformities are suppressed and images of high quality can be formed.

Composition of Inkjet Recording Apparatus

Next, an inkjet recording apparatus is described which forms an image recording apparatus according to an embodiment of the present invention. The inkjet recording apparatus has the density non-uniformity correction function described above.

Figure 13:
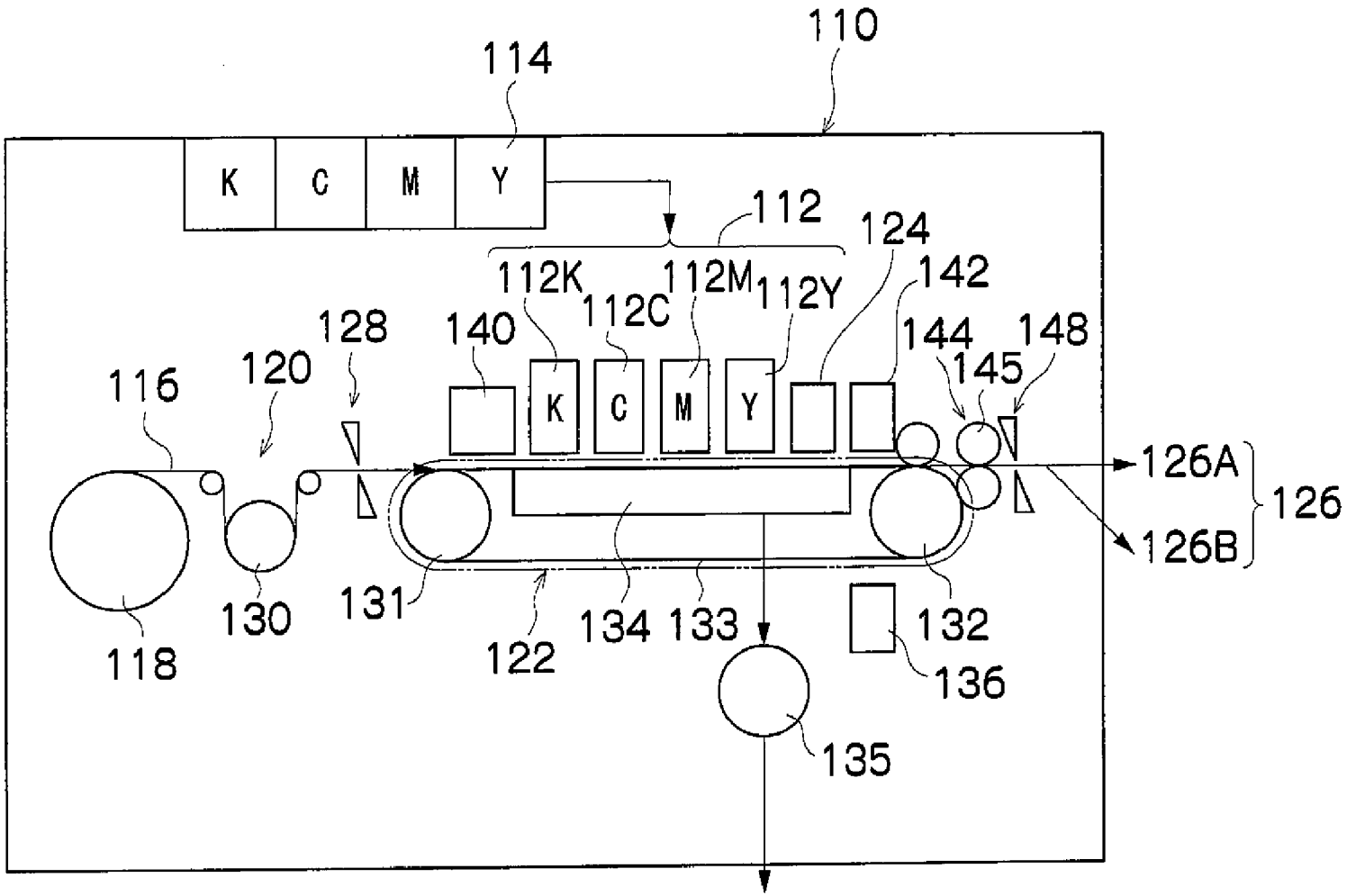
FIG. 13 is a general schematic drawing of an inkjet recording apparatus according to an embodiment of the present invention.

FIG. 13 is a general schematic drawing of an inkjet recording apparatus 110, which forms one embodiment of an image recording apparatus according to the present invention. As shown in FIG. 13, the inkjet recording apparatus 110 comprises: a print unit 112 having a plurality of inkjet recording heads (hereinafter referred to as heads) 112K, 112C, 112M, and 112Y provided for ink colors of black (K), cyan (C), magenta (M), and yellow (Y), respectively; an ink storing and loading unit 114 for storing inks to be supplied to the heads 112K, 112C, 112M and 112Y; a paper supply unit 118 for supplying recording paper 116 forming a recording medium; a decurling unit 120 for removing curl in the recording paper 116; a belt conveyance unit 122, disposed facing the nozzle face (ink ejection face) of the print unit 112, for conveying the recording paper 116 while keeping the recording paper 116 flat; a print determination unit 124 for reading the printed result produced by the print unit 112; and a paper output unit 126 for outputting the recorded recording paper (printed matter) to the exterior.

The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels. The ink storing and loading unit 114 has a warning device (for example, a display device or an alarm sound generator) for warning when the remaining amount of any ink is low, and has a mechanism for preventing loading errors among the colors.

In FIG. 13, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording media can be used, it is preferable that an information recording medium such as a bar code and a wireless tag containing information about the type of recording medium is attached to the magazine, and by reading the information contained in the information recording medium with a predetermined reading device, the type of recording medium to be used is automatically determined, and ink-droplet ejection is controlled so that the ink-droplets are ejected in an appropriate manner in accordance with the type of medium.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine. The heating temperature at this time is preferably controlled so that the recording paper 116 has a curl in which the surface on which the print is to be made is slightly round outward.

In the case of the configuration in which roll paper is used, a cutter (first cutter) 128 is provided as shown in FIG. 13, and the continuous paper is cut into a desired size by the cutter 128. When cut papers are used, the cutter 128 is not required.

The decurled and cut recording paper 116 is delivered to the belt conveyance unit 122. The belt conveyance unit 122 has a configuration in which an endless belt 133 is set around rollers 131 and 132 so that the portion of the endless belt 133 facing at least the nozzle face of the print unit 112 and the sensor face of the print determination unit 124 forms a horizontal plane (flat plane).

The belt 133 has a width that is greater than the width of the recording paper 116, and a plurality of suction apertures (not shown) are formed on the belt surface. A suction chamber 134 is disposed in a position facing the sensor surface of the print determination unit 124 and the nozzle surface of the print unit 112 on the interior side of the belt 133, which is set around the rollers 131 and 132, as shown in FIG. 13. The suction chamber 134 provides suction with a fan 135 to generate a negative pressure, and the recording paper 116 is held on the belt 133 by suction. In place of the suction system, an electrostatic attraction system can be employed.

The belt 133 is driven in the clockwise direction in FIG. 13 by the motive force of a motor 188 (shown in FIG. 18) being transmitted to at least one of the rollers 131 and 132, which the belt 133 is set around, and the recording paper 116 held on the belt 133 is conveyed from left to right in FIG. 13.

Since ink adheres to the belt 133 when a marginless print job or the like is performed, a belt-cleaning unit 136 is disposed in a predetermined position (a suitable position outside the printing area) on the exterior side of the belt 133. Although the details of the configuration of the belt-cleaning unit 136 are not shown, embodiments thereof include a configuration in which the belt is nipped with cleaning rollers such as a brush roller and a water absorbent roller, an air blow configuration in which clean air is blown onto the belt 133, or a combination of these. In the case of the configuration in which the belt 133 is nipped with the cleaning rollers, it is preferable to make the line velocity of the cleaning rollers different than that of the belt 133 to improve the cleaning effect.

The inkjet recording apparatus may comprise a roller nip conveyance mechanism, instead of the belt conveyance unit 122. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 140 is disposed on the upstream side of the print unit 112 in the conveyance pathway formed by the belt conveyance unit 122. The heating fan 140 blows heated air onto the recording paper 116 to heat the recording paper 116 immediately before printing so that the ink deposited on the recording paper 116 dries more easily.

Figure 14:
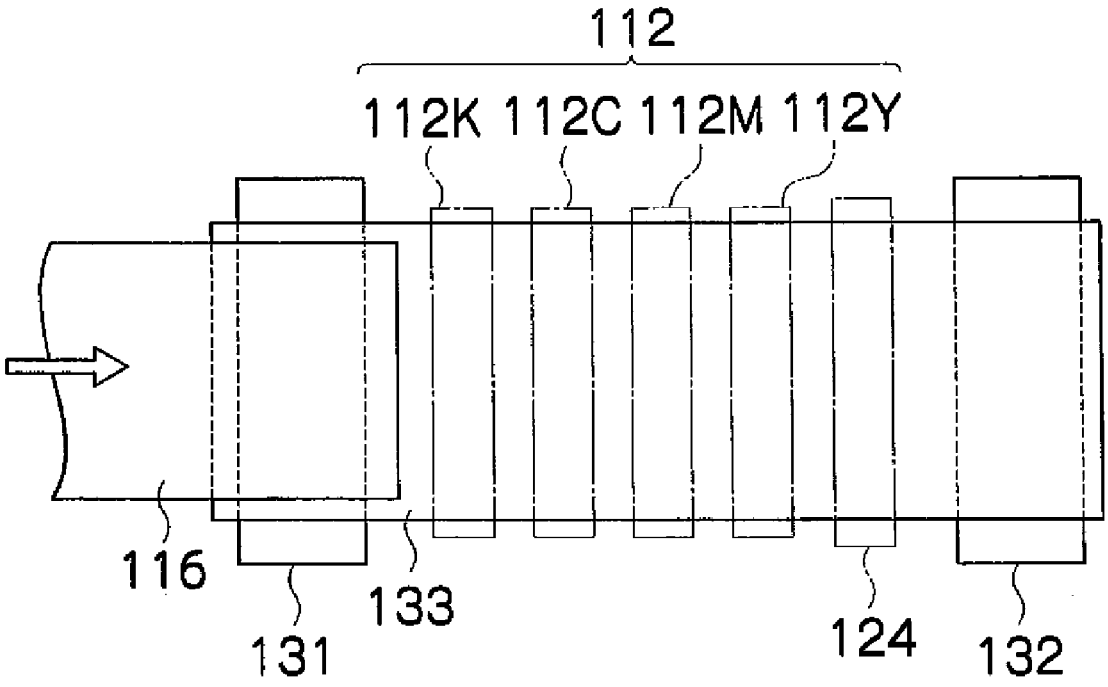
FIG. 14 is a principal plan diagram of the peripheral area of a print unit in the inkjet recording apparatus shown in FIG. 13.

The heads 112K, 112C, 112M and 112Y of the print unit 112 are full line heads having a length corresponding to the maximum width of the recording paper 116 used with the inkjet recording apparatus 110, and comprising a plurality of nozzles for ejecting ink arranged on a nozzle face through a length exceeding at least one edge of the maximum-size recording medium (namely, the full width of the printable range) (see FIG. 14).

The print heads 112K, 112C, 112M and 112Y are arranged in this color order (black (K), cyan (C), magenta (M), yellow (Y)) from the upstream side in the feed direction of the recording paper 116, and these heads 112K, 112C, 112M and 112Y are fixed extending in a direction substantially perpendicular to the conveyance direction of the recording paper 116.

A color image can be formed on the recording paper 116 by ejecting inks of different colors from the heads 112K, 112C, 112M and 112Y, respectively, onto the recording paper 116 while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the print unit 112 in the paper conveyance direction (the sub-scanning direction), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which inkjet heads for ejecting light-colored inks such as light cyan and light magenta are added. Furthermore, there are no particular restrictions of the sequence in which the heads of respective colors are arranged.

The print determination unit 124 shown in FIG. 13 has an image sensor (line sensor or area sensor) for capturing an image of the droplet ejection result of the print unit 112, and functions as a device to check the ejection characteristics, such as blockages, depositing position error, and the like, of the nozzles, on the basis of the image of ejected droplets read in by the image sensor. A test pattern or the target image printed by the print heads 112K, 112C, 112M, and 112Y of the respective colors is read in by the print determination unit 124, and the ejection performed by each head is determined. The ejection determination includes the presence of the ejection, measurement of the dot size, and measurement of the dot depositing position.

A post-drying unit 142 is disposed following the print determination unit 124. The post-drying unit 142 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In the inkjet recording apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 13, the paper output unit 126A for the target prints is provided with a sorter for collecting prints according to print orders.

Structure of Head

Next, the structure of the head is described. The heads 112K, 112C, 112M and 112Y of the respective ink colors have the same structure, and a reference numeral 150 is hereinafter designated to any of the heads.

Figure 15A:
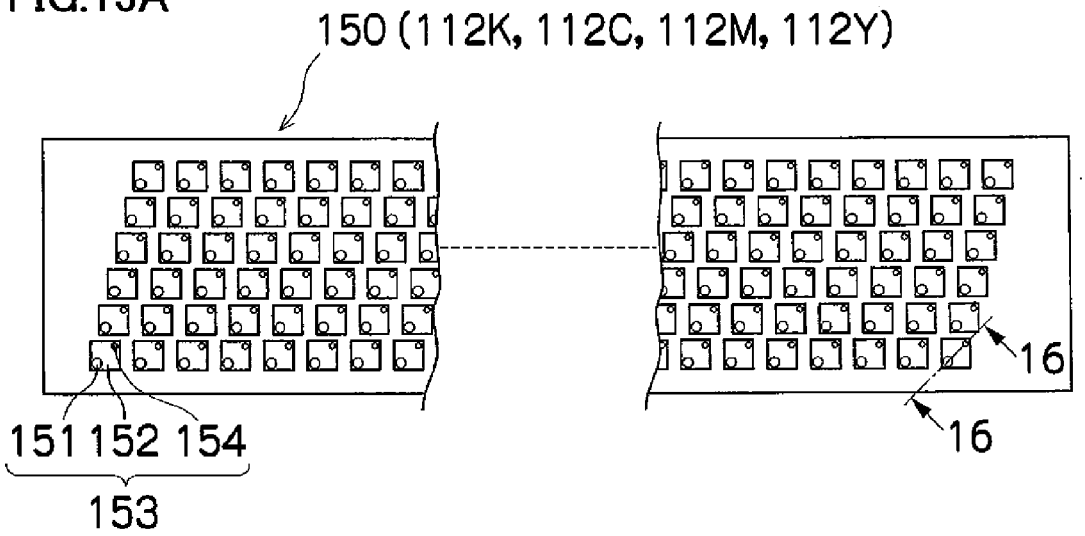
FIG. 15A is a plan view perspective diagram showing a compositional example of a print head.
Figure 15B:
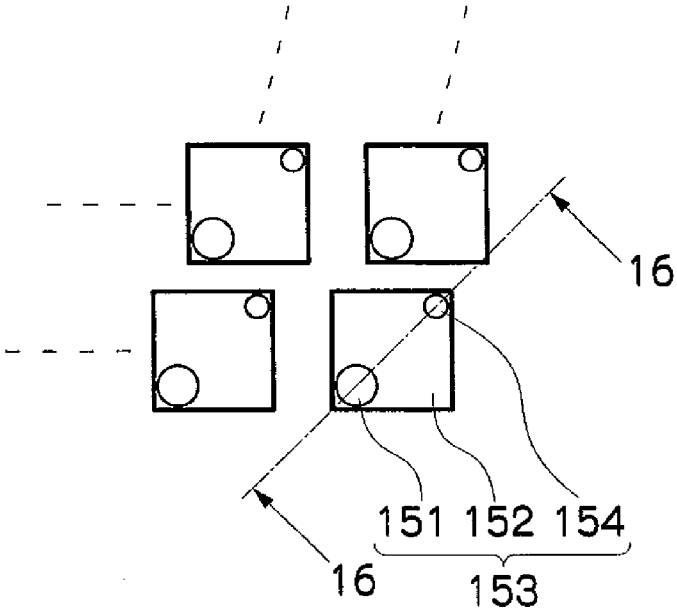
FIG. 15B is a principal enlarged view of FIG. 15A.
Figure 15C:
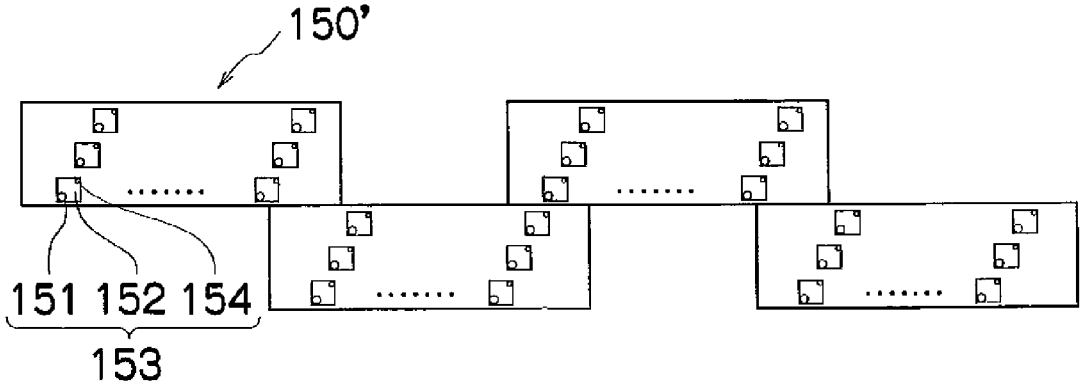
FIG. 15C is a plan view perspective diagram showing a further example of the structure of a full line head.
Figure 16:
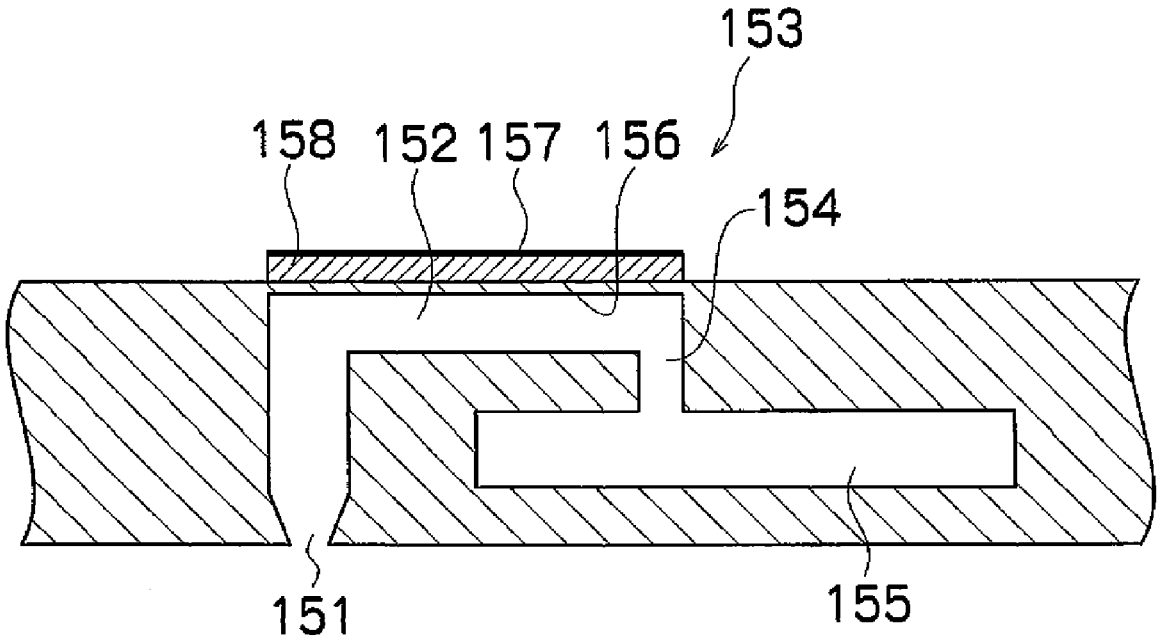
FIG. 16 is a cross-sectional view along line 16-16 in FIGS. 15A and 15B.

FIG. 15A is a perspective plan view showing an embodiment of the configuration of the head 150, FIG. 15B is an enlarged view of a portion thereof, FIG. 15C is a perspective plan view showing another embodiment of the configuration of the head 150, and FIG. 16 is a cross-sectional view taken along the line 16-16 in FIGS. 15A and 15B, showing the stereostructure of a droplet ejection element (an ink chamber unit for one nozzle 51) for one channel constituting a recording element unit.

The nozzle pitch in the head 150 should be minimized in order to maximize the resolution of the dots printed on the surface of the recording paper 116. As shown in FIGS. 15A and 15B, the head 150 according to the present embodiment has a structure in which a plurality of ink chamber units (droplet ejection elements) 153, each comprising a nozzle 151 forming an ink ejection port, a pressure chamber 152 corresponding to the nozzle 151, and the like, are disposed two-dimensionally in the form of a staggered matrix, and hence the effective nozzle interval (the projected nozzle pitch) as projected (orthogonal projection) in the lengthwise direction of the head (the direction perpendicular to the paper conveyance direction) is reduced and high nozzle density is achieved.

The mode of forming one or more nozzle rows through a length corresponding to the entire width of the recording paper 116 in a direction substantially perpendicular to the conveyance direction of the recording paper 116 is not limited to the embodiment described above. For example, instead of the configuration in FIG. 15A, as shown in FIG. 15C, a line head having nozzle rows of a length corresponding to the entire width of the recording paper 116 can be formed by arranging and combining, in a staggered matrix, short head modules 150' each having a plurality of nozzles 151 arrayed in a two-dimensional fashion.

As shown in FIGS. 15A and 15B, the planar shape of the pressure chamber 152 provided corresponding to each nozzle 151 is substantially a square shape, and an outlet port to the nozzle 151 is provided at one of the ends of the diagonal line of the planar shape, while an inlet port (supply port) 154 for supplying ink is provided at the other end thereof. The shape of the pressure chamber 152 is not limited to that of the present embodiment and various modes are possible in which the planar shape is a quadrilateral shape (rhombic shape, rectangular shape, or the like), a pentagonal shape, a hexagonal shape, or other polygonal shape, or a circular shape, elliptical shape, or the like.

As shown in FIG. 16 each pressure chamber 152 is connected to a common channel 155 through the supply port 154. The common channel 155 is connected to an ink tank (not shown), which is a base tank that supplies ink, and the ink supplied from the ink tank is delivered through the common flow channel 155 to the pressure chambers 152.

An actuator 158 provided with an individual electrode 157 is bonded to a pressure plate (a diaphragm that also serves as a common electrode) 156 which forms the surface of one portion (in FIG. 16 the ceiling) of the pressure chambers 152. When a drive voltage is applied to the individual electrode 157 and the common electrode, the actuator 158 deforms, thereby changing the volume of the pressure chamber 152. This causes a pressure change which results in ink being ejected from the nozzle 151. For the actuator 158, it is possible to adopt a piezoelectric element using a piezoelectric body, such as lead zirconate titanate, barium titanate, or the like. When the actuator 158 returns to its original position after ejecting ink by the displacement, the pressure chamber 152 is replenished with new ink from the common flow channel 155, through the supply port 154.

Figure 17:
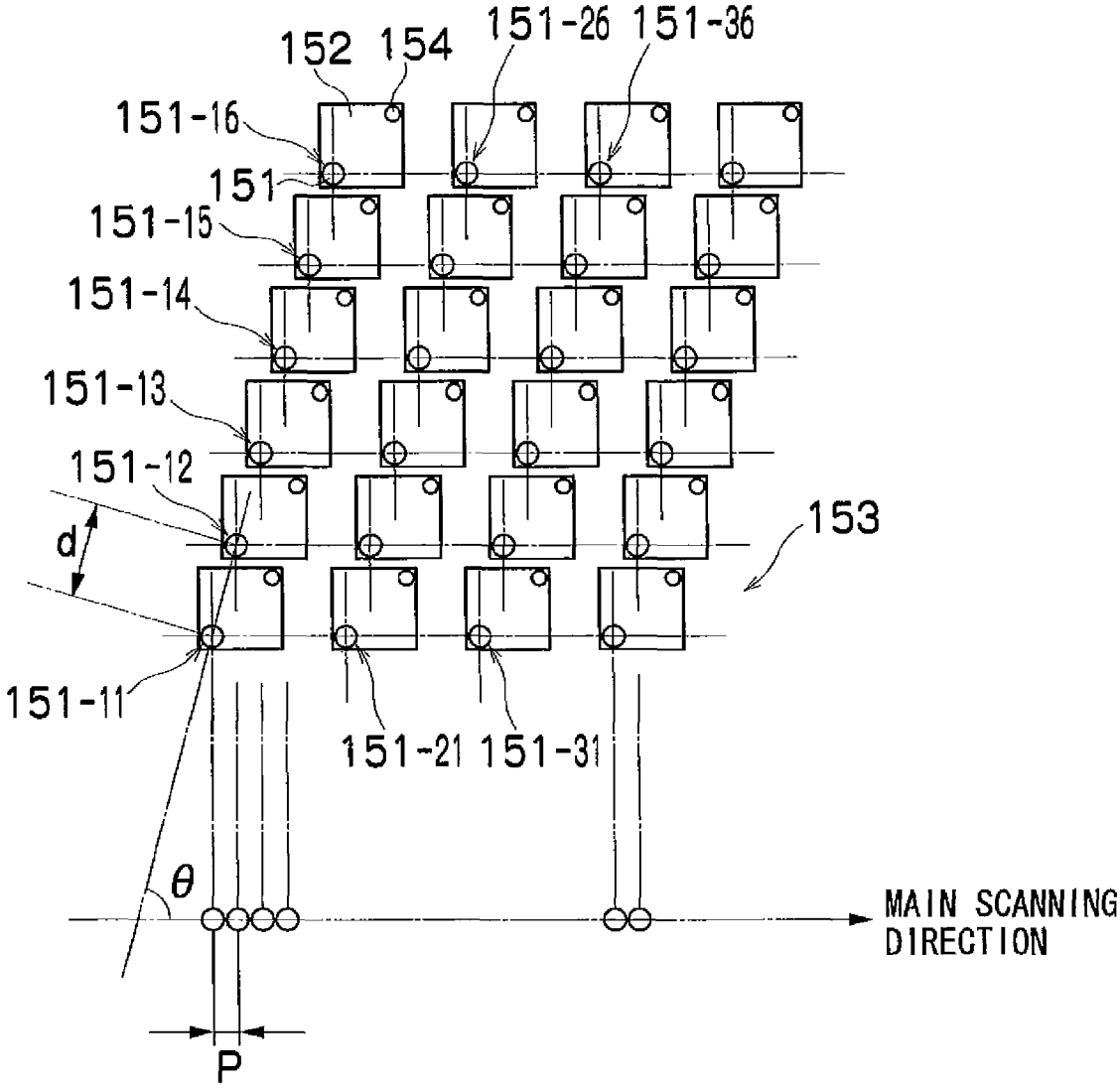
FIG. 17 is an enlarged view showing a nozzle arrangement in the print head shown in FIGS. 15A and 15B.

As shown in FIG. 17 the high-density nozzle head according to the present embodiment is achieved by arranging the plurality of ink chamber units 153 having the above-described structure in a lattice fashion based on a fixed arrangement pattern, in a row direction which coincides with the main scanning direction, and a column direction which is inclined at a fixed angle of $\theta$ with respect to the main scanning direction, rather than being perpendicular to the main scanning direction.

More specifically, by adopting the structure in which the plurality of ink chamber units 153 are arranged at a uniform pitch d in line with a direction forming the angle of $\theta$ with respect to the main scanning direction, the pitch P of the nozzles projected so as to align in the main scanning direction is $d \times \cos\theta$, and hence the nozzles 151 can be regarded to be equivalent to those arranged linearly at the fixed pitch P along the main scanning direction. Such configuration results in a nozzle structure in which the nozzle row projected in the main scanning direction has a high nozzle density of up to 2,400 nozzles per inch.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 151 arranged in a matrix such as that shown in FIG. 17 are driven, the main scanning according to the above-described (3) is preferred. More specifically, the nozzles 151-11, 151-12, 151-13, 151-14, 151-15 and 151-16 are treated as a block (additionally; the nozzles 151-21, 151-22, . . . , 151-26 are treated as another block; the nozzles 151-31, 151-32, . . . , 151-36 are treated as another block; . . . ); and one line is printed in the width direction of the recording paper 116 by sequentially driving the nozzles 151-11, 151-12, . . . , 151-16 in accordance with the conveyance velocity of the recording paper 116.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by main scanning as described above is referred to as the "main scanning direction", and the direction in which sub-scanning is performed, is referred to as the "sub-scanning direction". In other words, in the present embodiment, the conveyance direction of the recording paper 116 is referred to as the sub-scanning direction and the direction perpendicular to same is referred to as the main scanning direction.

In implementing the present invention, the arrangement of the nozzles is not limited to that of the embodiment shown. Moreover, a method is employed in the present embodiment where an ink droplet is ejected by means of the deformation of the actuator 158, which is typically a piezoelectric element; however, in implementing the present invention, the method used for discharging ink is not limited in particular, and instead of the piezo j et method, it is also possible to apply various types of methods, such as a thermal jet method where the ink is heated and bubbles are caused to form therein by means of a heat generating body such as a heater, ink droplets being ejected by means of the pressure applied by these bubbles.

Description of Control System

Figure 18:
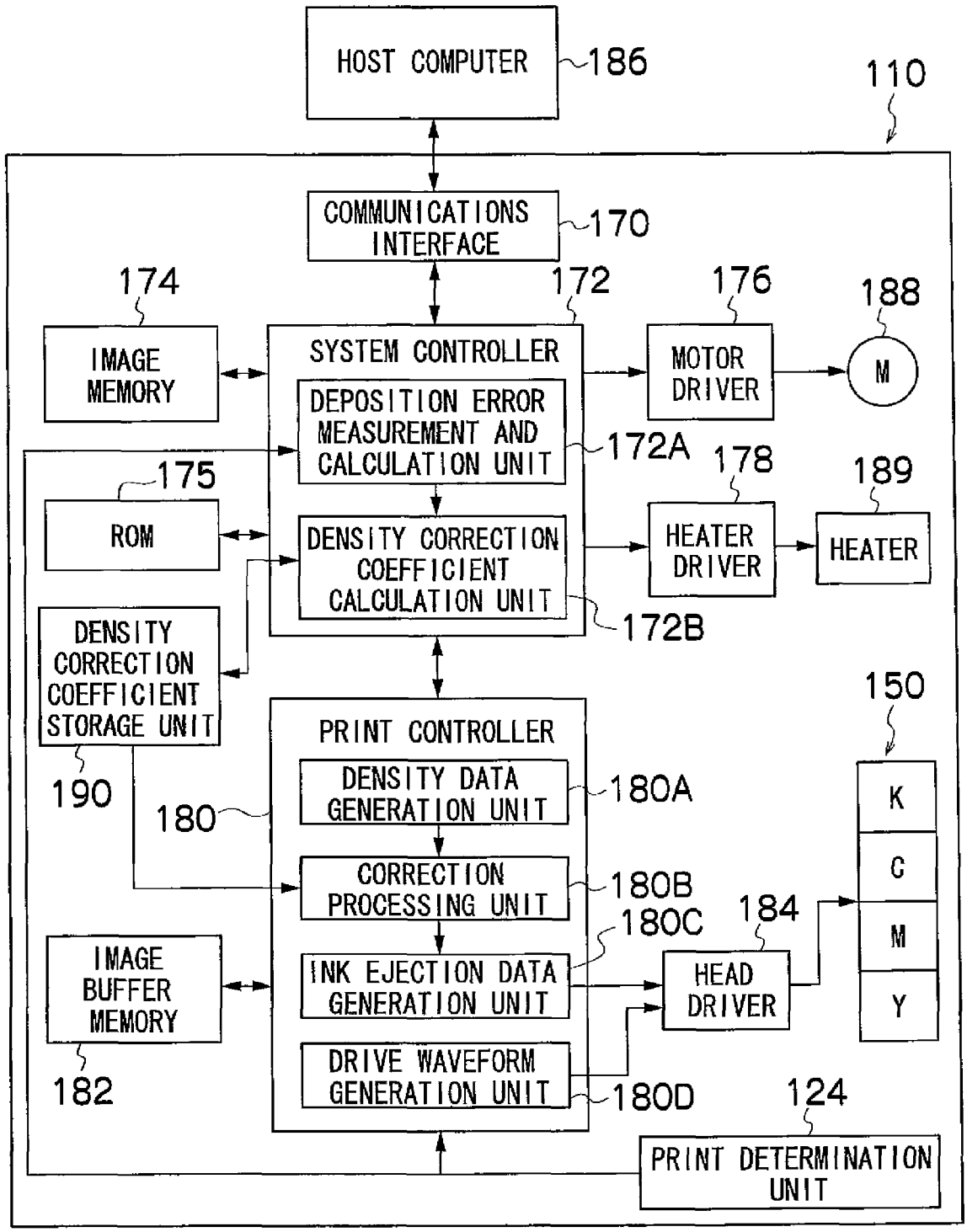
FIG. 18 is a principal block diagram showing the system configuration of the inkjet recording apparatus.
Figure 19:
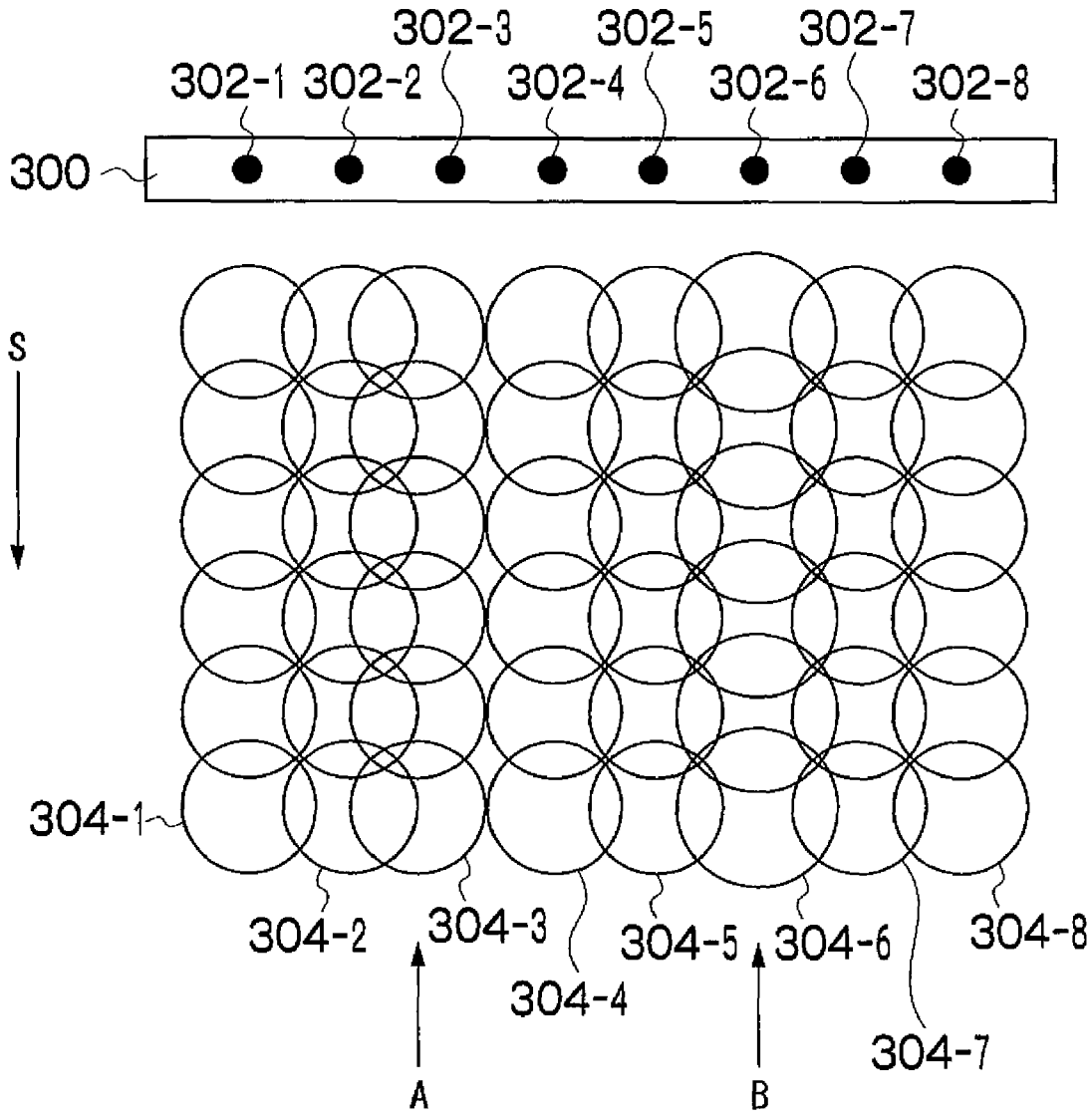
FIG.19 RELATED ART
FIG. 19 is a schematic drawing for describing the relationship between density non-uniformity and variation in the ejection characteristics of the nozzles.

FIG. 18 is a block diagram showing the system configuration of the inkjet recording apparatus 110. As shown in FIG. 18, the inkjet recording apparatus 110 comprises a communication interface 170, a system controller 172, an image memory 174, a ROM 175, a motor driver 176, a heater driver 178, a print controller 180, an image buffer memory 182, a head driver 184, and the like.

The communication interface 170 is an interface unit (image input device) for receiving image data sent from a host computer 186. A serial interface such as USB (Universal Serial Bus), IEEE1394, Ethernet (registered trademark), and wireless network, or a parallel interface such as a Centronics interface may be used as the communication interface 170. A buffer memory (not shown) may be mounted in this portion in order to increase the communication speed.

The image data sent from the host computer 186 is received by the inkjet recording apparatus 110 through the communication interface 170, and is temporarily stored in the image memory 174. The image memory 174 is a storage device for storing images inputted through the communication interface 170, and data is written and read to and from the image memory 174 through the system controller 172. The image memory 174 is not limited to a memory composed of semiconductor elements, and a hard disk drive or another magnetic medium may be used.

The system controller 172 is constituted by a central processing unit (CPU) and peripheral circuits thereof, and the like, and it functions as a control device for controlling the whole of the inkjet recording apparatus 110 in accordance with a prescribed program, as well as a calculation device for performing various calculations. More specifically, the system controller 172 controls the various sections, such as the communication interface 170, image memory 174, motor driver 176, heater driver 178, and the like, as well as controlling communications with the host computer 186 and writing and reading to and from the image memory 174 and the ROM 175, and it also generates control signals for controlling the motor 188 and heater 189 of the conveyance system.

Furthermore, the system controller 172 comprises a depositing error measurement and calculation unit 172A, which performs calculation processing for generating depositing position error data from the data read in from the test pattern by the print determination unit 124, and a density correction coefficient calculation unit 172B, which sets virtual deposited droplet and calculates density correction coefficients from the information relating to the depositing position error obtained by the depositing error measurement and calculation unit 172A. The processing functions of the depositing error measurement and calculation unit 172A and the density correction coefficient calculation unit 172B can be achieved by means of an ASIC (application specific integrated circuit), software, or a suitable combination of same.

The density correction coefficient data obtained by the density correction coefficient calculation unit 172B is stored in a density correction coefficient storage unit 190.

The program executed by the CPU of the system controller 172 and the various types of data (including data of the test pattern for obtaining depositing position error) which are required for control procedures are stored in the ROM 175. The ROM 175 may be a non-writeable storage device, or it may be a rewriteable storage device, such as an EEPROM. By utilizing the storage region of this ROM 175, the ROM 175 can be configured to be able to serve also as the density correction coefficient storage unit 190.

The image memory 174 is used as a temporary storage region for the image data, and it is also used as a program development region and a calculation work region for the CPU.

The motor driver (drive circuit) 176 drives the motor 188 of the conveyance system in accordance with commands from the system controller 172. The heater driver (drive circuit) 178 drives the heater 189 of the post-drying unit 142 or the like in accordance with commands from the system controller 172.

The print controller 180 is a control unit which functions as a signal processing device for performing various treatment processes, corrections, and the like, in accordance with the control implemented by the system controller 172, in order to generate a signal for controlling droplet ejection from the image data (multiple-value input image data) in the image memory 174, as well as functioning as a drive control device which controls the ejection driving of the head 150 by supplying the ink ejection data thus generated to the head driver 184.

In other words, the print controller 180 includes a density data generation unit 180A, a correction processing unit 180B, an ink ejection data generation unit 180C and a drive waveform generation unit 180D. These functional units (180A to 180D) can be realized by means of an ASIC, software or a suitable combination of same.

The density data generation unit 180A is a signal processing device which generates initial density data for the respective ink colors, from the input image data, and it carries out density conversion processing (including UCR processing and color conversion) described in step S22 in FIG. 11, and, where necessary, it also performs pixel number conversion processing.

The correction processing unit 180B in FIG. 18 is a processing device which performs density correction calculations using the density correction coefficients stored in the density correction coefficient storage unit 190, and it carries out the non-uniformity correction processing described in step S24 in FIG. 11.

The ink ejection data generation unit 180C in FIG. 18 is a signal processing device which includes a half-toning processing device for converting the corrected density data generated by the correction processing unit 180B into binary (or multiple-value) dot data, and it performs the binary (or multiple-value) conversion processing described in step S26 of FIG. 11. The ink ejection data generated by the ink ejection data generation unit 180C is supplied to the head driver 184, which controls the ink ejection operation of the head 150 accordingly.

The drive waveform generation unit 180D is a device for generating drive signal waveforms in order to drive the actuators 158 (see FIG. 16) corresponding to the respective nozzles 151 of the head 150. The signal (drive waveform) generated by the drive waveform generation unit 180D is supplied to the head driver 184. The signal outputted from the drive waveforms generation unit 180D may be digital waveform data, or it may be an analog voltage signal.

The image buffer memory 182 is provided in the print controller 180, and image data, parameters, and other data are temporarily stored in the image buffer memory 182 when image data is processed in the print controller 180. FIG. 18 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to print output, image data to be printed (original image data) is inputted from an external source through the communication interface 170, and is accumulated in the image memory 174. At this stage, multiple-value RGB image data is stored in the image memory 174, for example.

In this inkjet recording apparatus 110, an image which appears to have a continuous tonal graduation to the human eye is formed by changing the deposition density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 174 is sent to the print controller 180, through the system controller 172, and is converted to the dot data for each ink color by a half-toning technique, using dithering, error diffusion, or the like, by passing through the density data generation unit 180A, the correction processing unit 180B, and the ink ejection data generation unit 180C of the print controller 180.

In other words, the print controller 180 performs processing for converting the input RGB image data into dot data for the four colors of K, C, M and Y The dot data thus generated by the print controller 180 is stored in the image buffer memory 182. This dot data of the respective colors is converted into CMYK droplet ejection data for ejecting ink from the nozzles of the head 150, thereby establishing the ink ejection data to be printed.

The head driver 184 outputs drive signals for driving the actuators 158 corresponding to the nozzles 151 of the head 150 in accordance with the print contents, on the basis of the ink ejection data and the drive waveform signals supplied by the print controller 180. A feedback control system for maintaining constant drive conditions in the head may be included in the head driver 184.

By supplying the drive signals outputted by the head driver 184 to the head 150 in this way, ink is ejected from the corresponding nozzles 151. By controlling ink ejection from the print head 150 in synchronization with the conveyance speed of the recording paper 116, an image is formed on the recording paper 116.

As described above, the ejection volume and the ejection timing of the ink droplets from the respective nozzles are controlled through the head driver 184, on the basis of the ink ejection data generated by implementing prescribed signal processing in the print controller 180, and the drive signal waveform. By this means, prescribed dot size and dot positions can be achieved.

As described with reference to FIG. 13, the print determination unit 124 is a block including an image sensor, which reads in the image printed on the recording medium 116, performs various signal processing operations, and the like, and determines the print situation (presence/absence of ejection, variation in droplet ejection, optical density, and the like), these determination results being supplied to the print controller 180 and the system controller 172.

The print controller 180 implements various corrections with respect to the head 150, on the basis of the information obtained from the print determination unit 124, according to requirements, and it implements control for carrying out cleaning operations (nozzle restoring operations), such as preliminary ejection, suctioning, or wiping, as and when necessary.

In the case of the present embodiment, the combination of the print determination unit 124 and the depositing error measurement calculation unit 172A corresponds to the "characteristics information acquisition device", and the density correction coefficient calculation unit 172B corresponds to the "correction range setting device", the "correction coefficient determination device" and the "correction object determination device" which determines correction object recording elements (nozzles) that are to be corrected. Furthermore, the correction processing unit 180B corresponds to the "correction processing device".

According to the inkjet recording apparatus 110 having the foregoing composition, it is possible to obtain a satisfactory image in which density non-uniformity due to the depositing position errors is reduced.

MODIFICATION EXAMPLE 1

It is also possible to adopt a mode in which all or a portion of the functions carried out by the depositing error measurement calculation unit 172A, the density correction coefficient calculation unit 172B, the density data generation unit 180A and the correction processing unit 180B, which are described in FIG. 18, are installed in the host computer 186.

MODIFICATION EXAMPLE 2

FIGS. 13 to 18 show an example of a composition where a test pattern is read in by a print determination unit 124 which is provided in an inkjet recording apparatus 110, and a calculation processing function for obtaining deposition error data and a calculation processing function for determining density correction coefficients are incorporated into the system controller (reference numeral 172 in FIG. 18) and/or the print controller (reference numeral 180) of the inkjet recording apparatus 110, in such a manner that the calculation processing is carried out inside the inkjet recording apparatus 110. However, it is also possible to achieve these functions by means of an image reading apparatus which is a device for reading in a test pattern. Moreover, it is also possible to perform these functions by means of an apparatus that is external to the printer so that the image data obtained from the image reading apparatus is processed.

For example, it is also possible to use a flat-bed scanner, or the like, as the image reading apparatus which reads in the test pattern. Furthermore, it is also possible to adopt a composition which uses a computer other than the inkjet recording apparatus 110, as a calculation device for analyzing the data which has been read in and calculating the density correction coefficients. In this case, a program which causes a computer to execute an image analysis algorithm used in measuring the deposition error data as described in step S12 in FIG. 10 and an algorithm for calculating the density correction coefficients as described in steps S14 to 16 is installed in the computer, and the computer is made to function as a calculation apparatus by running this program.

MODIFICATION EXAMPLE 3

In the respective embodiments described above, an inkjet recording apparatus using a page-wide full line type head having a nozzle row of a length corresponding to the entire width of the recording medium was described, but the scope of application of the present invention is not limited to this, and beneficial corrective effects can also be obtained in respect of banding non-uniformities in an inkjet recording apparatus which performs image recording by means of a plurality of head scanning actions which move a short recording head, such as a serial head (shuttle scanning head), or the like.

In the foregoing description, an inkjet recording apparatus was described as one example of an image forming apparatus, but the scope of application of the present invention is not limited to this.

In the embodiment described above, an inkjet recording apparatus was described as one example of an image forming apparatus, but the range of application of the present invention is not limited to this. It is also possible to apply the present invention to image recording apparatuses employing various types dot recording methods, apart from an inkjet apparatus, such as a thermal transfer recording apparatus equipped with a recording head which uses thermal elements are recording elements, an LED electrophotographic printer equipped with a recording head having LED elements as recording elements, or a silver halide photographic printer having an LED line type exposure head, or the like.

Furthermore, the meaning of the term "image recording apparatus" is not restricted to a so-called graphic printing application for printing photographic prints or posters, but rather also encompasses industrial apparatuses which are able to form patterns that may be perceived as images, such as resist printing apparatuses, wire printing apparatuses for electronic circuit substrates, ultra-fine structure forming apparatuses, etc., which use inkjet technology.

Furthermore, the range of application of the present invention is not limited to the correction of density non-uniformities caused by error in depositing position, and a correction effect can also be obtained by applying a method similar to the above-described correction processing to density non-uniformities caused by droplet volume errors, density non-uniformities caused by the presence of nozzles suffering ejection failure, density non-uniformities caused by periodic print errors, and density non-uniformities caused by various other types of factors.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus which records an image on a recording medium, the image recording apparatus comprising:

a recording head which has a plurality of recording elements;

a conveyance device which conveys at least one of the recording head and the recording medium so that the recording head and the recording medium move relatively to each other;

a characteristics information acquisition device which acquires information that indicates recording characteristics of the plurality of recording elements;

a correction object determination device which selects from the plurality of recording elements a correction object recording element to be corrected, the correction object recording element having the recording characteristics that cause density non-uniformity in the image;

a correction range setting device which selects from the plurality of recording elements N correction recording elements to be used for correcting an output density, N being an integer not less than 2;

a virtual dot setting device which sets a virtual dot to be arranged at an overlapping portion where an overlap occurs between mutually adjacent dots recorded by the selected correction recording elements, the virtual dot being set for calculation purposes to correct the output density at the overlapping portion and not actually recorded on the recording medium, the virtual dot setting device also determining a virtual density of the virtual dot for the calculation purposes;

a correction coefficient determination device which calculates the density non-uniformity caused by the virtual dot and the recording characteristics of the correction object recording element and which determines density correction coefficients for the N correction recording elements in accordance with correction conditions that reduce a low-frequency component of a power spectrum representing spatial frequency characteristics of the calculated density non-uniformity;

a correction processing device which performs calculation for correcting the output density by using the density correction coefficients determined by the correction coefficient determination device; and a drive control device which controls the plurality of recording elements in accordance with the output density corrected by the correction processing device.

2. The image recording apparatus as defined in claim 1, wherein the correction conditions are such that differential coefficients of the power spectrum representing the spatial frequency characteristics of the density non-uniformity become substantially zero at a frequency origin point (f=0).

3. The image recording apparatus as defined in claim 2, wherein the correction conditions are expressed by N simultaneous equations derived from conditions under which a DC component of the spatial frequency is preserved and the differential coefficients of the power spectrum up to (N−1)-th order become substantially zero.

4. The image recording apparatus as defined in claim 1, wherein the recording characteristics include recording position error.

5. The image recording apparatus as defined in claim 1, wherein the virtual dot is arranged at a midpoint between adjacent two of the dots recorded by the correction recording elements.

6. The image recording apparatus as defined in claim 1, wherein the virtual dot is arranged at a position that is determined in accordance with densities and positions of adjacent two of the dots recorded by the correction recording elements.

7. The image recording apparatus as defined in claim 1, wherein the virtual density of the virtual dot is determined in accordance with densities of adjacent two of the dots recorded by the correction recording elements and an interval between the adjacent two of the dots.

8. The image recording apparatus as defined in claim 1, wherein the virtual density of the virtual dot takes a negative value.

9. The image recording apparatus as defined in claim 1, wherein the virtual dot is set to be arranged between the dots mutually adjacent in a direction in which depositing positions of the N correction recording elements are aligned.

10. An image recording method of recording an image on a recording medium while moving the recording medium and a recording head that has a plurality of recording elements relatively to each other by conveying at least one of the recording medium and the recording head, the method comprising:

a characteristics information acquisition step of acquiring information that indicates recording characteristics of the plurality of recording elements;

a correction object determination step of selecting from the plurality of recording elements a correction object recording element to be corrected, the correction object recording element having the recording characteristics that cause density non-uniformity in the image;

a correction range setting step of selecting from the plurality of recording elements N correction recording elements to be used for correcting an output density, N being an integer not less than 2;

a virtual dot setting step of setting a virtual dot to be arranged at an overlapping portion where an overlap occurs between mutually adjacent dots recorded by the selected correction recording elements and determining a virtual density of the virtual dot for calculation purposes to correct the output density at the overlapping portion, the virtual dot being set for the calculation purposes and not actually recorded on the recording medium;

a correction coefficient determination step of calculating the density non-uniformity caused by the virtual dot and the recording characteristics of the correction object recording element and then determining density correction coefficients for the N correction recording elements in accordance with correction conditions that reduce a low-frequency component of a power spectrum representing spatial frequency characteristics of the calculated density non-uniformity;

a correction processing step of performing calculation for correcting the output density by using the density correction coefficients determined in the correction coefficient determination step; and a drive control step of controlling the plurality of recording elements in accordance with the output density corrected in the correction processing step.

11. The method as defined in claim 10, wherein the virtual density of the virtual dot takes a negative value.

12. The method as defined in claim 10, wherein the virtual dot is set to be arranged between the dots mutually adjacent in a direction in which depositing positions of the N correction recording elements are aligned.

13. A method of determining density correction coefficients, comprising:

a characteristics information acquisition step of acquiring information that indicates recording characteristics of a plurality of recording elements arranged in a recording head, the plurality of recording elements recording an image on a recording medium;

a correction object determination step of selecting from the plurality of recording elements a correction object recording element to be corrected, the correction object recording element having the recording characteristics that cause density non-uniformity in the image;

a correction range setting step of selecting from the plurality of recording elements N correction recording elements to be used for correcting an output density, N being an integer not less than 2;

a virtual dot setting step of setting a virtual dot to be arranged at an overlapping portion where an overlap occurs between mutually adjacent dots recorded by the selected correction recording elements and determining a virtual density of the virtual dot for calculation purposes to correct the output density at the overlapping portion, the virtual dot being set for the calculation purposes and not actually recorded on the recording medium; and a correction coefficient determination step of calculating the density non-uniformity caused by the virtual dot and the recording characteristics of the correction object recording element and then determining density correction coefficients for the N correction recording elements in accordance with correction conditions that reduce a low-frequency component of a power spectrum representing spatial frequency characteristics of the calculated density non-uniformity.

14. A computer readable medium storing instructions causing a computer to perform the steps of the method of determining density correction coefficients as defined in claim 13.

15. The method as defined in claim 13, wherein the virtual density of the virtual dot takes a negative value.

16. The method as defined in claim 13, wherein the virtual dot is set to be arranged between the dots mutually adjacent in a direction in which depositing positions of the N correction recording elements are aligned.

* * * * *